US008026199B2

(12) United States Patent
Matsui et al.

(10) Patent No.: US 8,026,199 B2
(45) **Date of Patent: *Sep. 27, 2011**

(54) LUBRICATING OIL COMPOSITION

(75) Inventors: Shigeki Matsui, Yokohama (JP); Koji Hoshino, Yokohama (JP); Shigeki Takeshima, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 484 days.

This patent is subject to a terminal disclaimer.

(21) Appl. No.: 11/933,634

(22) Filed: Nov. 1, 2007

(65) Prior Publication Data

US 2008/0110799 A1 May 15, 2008

(30) Foreign Application Priority Data

Nov. 10, 2006 (JP) ..... 2006-305750
Dec. 25, 2006 (JP) ..... 2006-348252

(51) Int. Cl.
*C10M 141/00* (2006.01)
*C10M 157/00* (2006.01)
*C10M 171/02* (2006.01)

(52) U.S. Cl. ..... 508/591; 508/192; 508/363; 508/433; 208/18; 208/19

(58) Field of Classification Search ..... 208/18, 208/19; 585/1; 508/189, 192, 518, 346
See application file for complete search history.

(56) References Cited

U.S. PATENT DOCUMENTS

| | | | | |
|---|---|---|---|---|
| 4,263,152 | A | 4/1981 | King et al. | |
| 5,064,546 | A | 11/1991 | Dasai | |
| 5,354,484 | A | 10/1994 | Schwind et al. | |
| 5,552,068 | A | 9/1996 | Griffith | |
| 5,595,964 | A | 1/1997 | Bardasz | |
| 5,744,430 | A | 4/1998 | Inoue et al. | |
| 5,792,731 | A | 8/1998 | Ichihashi et al. | |
| 6,001,780 | A | 12/1999 | Ho et al. | |
| 6,114,288 | A | 9/2000 | Fujitsu et al. | |
| 6,303,546 | B1 | 10/2001 | Hata et al. | |
| 6,306,801 | B1 | 10/2001 | Yagishita et al. | |
| 6,323,162 | B1 | 11/2001 | Yasunori et al. | |
| 6,569,818 | B2 | 5/2003 | Nakazato et al. | |
| 6,569,819 | B2 | 5/2003 | Yagishita et al. | |
| 6,617,286 | B2 | 9/2003 | Sato et al. | |
| 6,638,897 | B2 | 10/2003 | Ogano et al. | |
| 6,720,293 | B2 | 4/2004 | Bovington et al. | |
| 6,756,346 | B1 | 6/2004 | Baba et al. | |
| 6,815,401 | B2 | 11/2004 | Nakamura | |
| 2001/0004389 | A1 | 6/2001 | Kimura et al. | |
| 2002/0002120 | A1 | 1/2002 | Gahagan | |
| 2002/0142922 | A1 | 10/2002 | Yagishita et al. | |
| 2004/0110647 | A1 | 6/2004 | Gapinski | |
| 2004/0176260 | A1 | 9/2004 | Shirahama et al. | |
| 2005/0261147 | A1* | 11/2005 | Rosenbaum et al. | 508/469 |
| 2006/0100467 | A1* | 5/2006 | Holmes et al. | 585/1 |
| 2006/0111255 | A1* | 5/2006 | Shirahama et al. | 508/469 |
| 2006/0131210 | A1* | 6/2006 | Rosenbaum et al. | 208/18 |
| 2006/0135378 | A1 | 6/2006 | Takahashi et al. | |
| 2006/0172898 | A1* | 8/2006 | Roby et al. | 508/485 |
| 2006/0201852 | A1* | 9/2006 | Rosenbaum et al. | 208/19 |
| 2007/0287643 | A1 | 12/2007 | Matsui et al. | |
| 2008/0026967 | A1 | 1/2008 | Suda et al. | |
| 2008/0110799 | A1 | 5/2008 | Matsui et al. | |
| 2011/0034358 | A1 | 2/2011 | Komatsubara | |

FOREIGN PATENT DOCUMENTS

| | | | |
|---|---|---|---|
| EP | 0 281 992 | A2 | 9/1988 |
| EP | 0 686 689 | A2 | 12/1995 |
| JP | 56-10591 | A | 2/1981 |
| JP | 63-223094 | A | 9/1988 |
| JP | 04-036391 | A | 2/1992 |
| JP | 8-302378 | A | 11/1996 |
| JP | 9-3463 | A | 1/1997 |
| JP | 11-293266 | A | 10/1999 |
| JP | 11286696 | A | 10/1999 |
| JP | 2000-001682 | A | 1/2000 |
| JP | 2000-256690 | A | 9/2000 |
| JP | 2000319682 | A | 11/2000 |
| JP | 2001164283 | A | 6/2001 |
| JP | 2001-279287 | A | 10/2001 |
| JP | 2002129182 | A | 5/2002 |
| JP | 2002-294271 | A | 10/2002 |
| JP | 2003-041283 | A | 2/2003 |

(Continued)

OTHER PUBLICATIONS

Office Action dated Dec. 2, 2009 in U.S. Appl. No. 11/757,109.

(Continued)

*Primary Examiner* — Ellen McAvoy
*Assistant Examiner* — Pamela H Weiss
(74) *Attorney, Agent, or Firm* — Panitch Schwarze Belisario & Nadel LLP

(57) ABSTRACT

The present invention provide a lubricating oil composition suitable for internal combustion engines, which composition is excellent in thermal/oxidation stability and can inhibit the increases of the viscosity and acid number even in the presence of NOx and can be used for a long period of time or provide a lubricating oil composition particularly suitable for diesel or direct injection engines equipped with an exhaust-gas after-treatment device such as DPF or various catalysts, which composition is excellent in high-temperature detergency and base number retention properties and further can achieve the effect of inhibit wear caused by soot contamination in the oil occurring significantly when the content of phosphorus compounds such as ZnDTP is decreased, at a high level and can inhibit the exhaust-gas after-treatment device from being adversely affected. The lubricating oil composition comprises a lubricating base oil containing, a specific amount of a base oil with specific properties, and two or more types of additives selected from specific additives.

14 Claims, No Drawings

FOREIGN PATENT DOCUMENTS

| | | | |
|---|---|---|---|
| JP | 2003-514099 | A | 4/2003 |
| JP | 2004-010799 | A | 1/2004 |
| JP | 2004-262979 | A | 9/2004 |
| JP | 2004-277712 | A | 10/2004 |
| WO | 98/26030 | A1 | 6/1998 |
| WO | 99/31113 | A1 | 6/1999 |
| WO | 0134735 | A1 | 5/2001 |
| WO | 02070636 | A1 | 9/2002 |
| WO | 2004/069967 | A1 | 8/2004 |
| WO | 2005/095556 | A1 | 10/2005 |

OTHER PUBLICATIONS

Office Action dated May 27, 2009 in U.S. Appl. No. 11/757,109.
Office Action dated Jan. 14, 2009 in U.S. Appl. No. 10/800,949.
Office Action dated May 2, 2008 in U.S. Appl. No. 10/800,949.
Office Action dated Oct. 31, 2007 in U.S. Appl. No. 10/800,949.
Office Action dated Apr. 3, 2007 in U.S. Appl. No. 10/800,949.
Int'l Search Report issued on Jun. 9, 2009 in Int'l Application No. PCT/JP2009/001457.

* cited by examiner

LUBRICATING OIL COMPOSITION

BACKGROUND OF THE INVENTION

The present invention relates to lubricating oil compositions and more specifically to those with excellent thermal/oxidation stability and an excellent effect of inhibiting the increases of the viscosity and acid number even in the presence of NOx, thus suitable for internal combustion engines. The present invention also relates to lubricating oil compositions with excellent high-temperature detergency and base number retention properties and those having such excellent properties and still highly capable of achieving the effect of inhibiting wear caused by soot contamination in the composition and inhibit an exhaust-gas after-treatment device from being adversely affected, thus suitable for diesel and direct injection engines equipped with such a device.

The lubricating oil used in internal combustion engines such as automobile engines has been required to have thermal/oxidation stability for use under severe conditions for a long period of time. Conventional lubricating oils for internal combustion engines comprises a high performance base oil such as a highly refined mineral oil or synthetic oil, blended with zinc dithiophosphate (ZDTP), molybdenum dithiocarbamate (MoDTC), or a phenolic anti-oxidant (see, for example, Japanese Patent Laid-Open Publication Nos. 4-36391, 63-223094, 8-302378, and 9-3463).

However, for recent more severe service conditions against the lubricating oil for internal combustion engines and reduction in waste oil disposal, the lubricating oil is further required to have a longer service life. However, conventional high performance base oils are not necessarily sufficient in their own thermal/oxidation stability. Alternatively, even though an anti-oxidant is added in a larger amount, there is a certain limit to improve thermal/oxidation stability. Thus, a further improvement must be sought in order to meet such requirements. In particular, since in the presence of $NO_x$, the viscosity and acid number of a lubricating oil are significantly increased due to oxidation degradation, a long-life lubricating oil has been demanded which can sufficiently suppress the oxidation degradation.

In recent years, a lubricating oil composition has been proposed which contains a phosphorus compound with less or no sulfur in place of ZDTP (see, for example, Japanese Patent Laid-Open Publication No. 2002-294271). However, it must be further improved in suppression of viscosity or acid number increase in the presence of NOx, and a lubricating oil containing ZDTP must be significantly improved in this regard.

Further, in the background of environment issues, the regulation against exhaust gas emission throughout the world has become tightened year by year. In particular, the exhaust gas from a diesel engine is urgently required to be decreased in NOx or suspended particle matters (SPM). Conventionally, in order to decrease the emission of these materials, it has been studied to introduce means for decreasing exhaust gas, such as a high-pressure injection system, an exhaust-gas recycling (EGR) system, an oxidation catalyst, a diesel particulate filter (DPF), or a NOx adsorber, into an diesel engine. It is known that among these emission control means, an exhaust-gas after-treatment device such as an oxidation catalyst, NOx adsorber, and DPF in particular are shortened in service life depending on the composition of the lubricating oil to be used. For example, in the case of using a lubricating oil containing zinc dialkyldithiophosphate (hereinafter referred to as "ZnDTP") that is effective as an anti-wear agent or anti-oxidant (peroxide decomposer), it is known that the zinc contained in ZnDTP forms an oxide or a phosphoric acid salt during the combustion process and there is the possibility that such an oxide or salt may degrade the purification performance of the exhaust-gas after-treatment device because it accumulates on the catalyst surface or in the filter. Therefore, a lubricating oil for an engine equipped with the exhaust-gas after-treatment device as described above desirously contains no ZnDTP or a small amount thereof even if added. Further, a metallic detergent and sulfur components are preferably decreased as much as possible because a sulfuric acid salt and an oxide accumulate in the form of ash and thus are likely to cause the foregoing problems.

However, in a diesel engine, in particular that equipped with an EGR, a large amount of soot contaminates the lubricating oil. Therefore, when the content of the ZnDTP, metallic detergent or sulfur components in the lubricating oil is simply decreased, there is a concern that the valve train wear would be increased and high-temperature detergency such as piston detergency would be poor. With regard to a direct injection gasoline engine, there also arises a concern that soot contamination in the lubricating oil would cause adverse affects similar to the foregoing and the formation of deposit on the combustion chamber and valves. Therefore, when the contents of the ZnDTP, metallic detergent and sulfur components are decreased, it is necessary to research and develop new measures for compensating the detergency and anti-wear properties degraded in connection with the decreased contents.

As a lubricating oil composition for an engine equipped with an exhaust-gas after-treatment device, Japanese Patent Laid-Open Publication No. 2000-256690 proposes a diesel engine oil composition, the sulfated ash content of which is held down to 0.7 percent by mass or less. Japanese Patent Laid-Open Publication No. 2001-279287 proposes an engine oil containing a dispersant type viscosity index improver for significantly improving the detergency when soot contaminates the oil. As an oil which is improved in anti-wear properties when soot contamination occurs therein, Japanese Patent Laid-Open Publication No. 2004-10799 proposes a lubricating oil composition containing a dispersant type viscosity index improver with a specific molecular weight similar to that disclosed in No. 2001-279287. However, these proposals are not necessarily sufficiently improved in high-temperature detergency or base number retention properties as a metallic detergent is decreased and do not discuss about high-temperature detergency as ZnDTP is decreased or about anti-wear properties as soot contaminates the oils. As the result, further consideration is needed in order to maintain or improve high-temperature detergency and base number retention properties at or to a higher level and inhibit wear caused by soot contamination in the oil, occurring significantly when the content of ZnDTP is decreased.

BRIEF SUMMARY OF THE INVENTION

The present invention was accomplished in view of the above-described circumstances and has a first of object to provide a lubricating oil composition which is excellent in thermal/oxidation stability and can inhibit the increases of the viscosity and acid number even in the presence of NOx and achieve a long service life, suitable for an internal combustion engine. The present invention has a second object to provide a lubricating oil composition which is excellent in high-temperature detergency and base number retention properties. The present invention has a third object to provide an engine oil composition which is also excellent in the above properties and is highly effective in inhibiting wear caused by soot contamination in the oil occurring significantly when the content of phosphorus compounds such as ZnDTP is decreased, in particular suitable as diesel and direct injection engine oils that can inhibit an exhaust-gas after-treatment device from being adversely affected.

As the result of extensive research and study carried out the inventors of the present invention, the present invention was accomplished on the basis of the finding that the above objects were able to be accomplished with a lubricating oil composition comprising a specific base oil blended with specific additives selected from the group consisting of a viscosity index improver, a phosphorus-containing anti-wear agent, a metallic agent, an anti-oxidant, and an organic molybdenum compound.

That is, according to the present invention, there is provided a lubricating oil composition comprising:

a lubricating base oil containing, on the basis of the total mass thereof, 40 percent by mass or more of base oil (X) with a kinematic viscosity at 100° C. of 1 to 8 $mm^2/s$, a pour point of −15° C. or lower, and an aniline point of 100° C. or higher, the saturates of the base oil containing 40 percent by mass or more of paraffins, 25 percent by mass or less of one ring naphthenes, and 35 percent by mass or less of two to six ring naphthenes, the ratio of the tertiary carbon in the whole carbon constituting the base oil being 6.3 percent or greater; and two or more additives selected from the group consisting of:

(A) (a) a non-dispersant type olefin (co)polymer viscosity index improver;

(B) a phosphorus-containing anti-wear agent;

(C) a metallic detergent:

(D) an ashless anti-oxidant, and (E) an organic molybdenum compound.

The iodine number of the base oil (X) is preferably 2 or less.

The base oil (X) is preferably a base oil produced through a process including a catalytic dewaxing process.

The lubricating oil composition preferably contains (b) a viscosity index improver other than component (a), as Component (A) to be such that the content ratio (mass ratio) of component (b) to the total amount of components (a) and (b) is to be 0.5 or less.

The lubricating oil composition preferably contains one or more type selected from the group consisting of (F) a sulfuric extreme pressure additive and (G) a boron-containing ashless dispersant.

The lubricating oil composition is preferably used for internal combustion engines.

The lubricating oil composition is preferably used for diesel and direct injection engines.

The lubricating oil composition of the present invention is a lubricating oil composition suitable for internal combustion engines, which composition is excellent in thermal/oxidation stability and can inhibit the increases of the viscosity and acid number even in the presence of NOx and can be used for a long period of time. Further, in particular the lubricating oil composition of the present invention is a lubricating oil composition suitable for diesel or direct injection engines equipped with an exhaust-gas after-treatment device such as DPF or various catalysts, which composition is excellent in high-temperature detergency and base number retention properties and further can achieve the effect of inhibit wear caused by soot contamination in the oil occurring significantly when the content of phosphorus compounds such as ZnDTP is decreased, at a high level and can inhibit the exhaust-gas after-treatment device from being adversely affected. Not only for such diesel engines, the lubricating oil composition can be suitably used for gasoline engines and gas engines for two- and four-wheeled vehicles, and engines for power generators, and cogenerations. Further, the lubricating oil composition can be used suitably not only in these various engines using a fuel, the sulfur content of which is 50 ppm by mass or less but also in various engines for ships and outboard motors.

DETAILED DESCRIPTION OF THE INVENTION

The present invention will be described in more detail below.

The lubricating oil composition of the present invention (hereinafter also referred to as "the composition of the present invention") comprises a lubricating base oil containing, on the basis of the total mass thereof, base oil (X) with a kinematic viscosity at 100° C. of 1 to 8 $mm^2/s$, a pour point of −15° C. or lower, and an aniline point of 100° C. or higher, the saturates of which base oil contains 40 percent by mass or more of paraffins, 25 percent by mass or less of one ring naphthenes, and 35 percent by mass or less of two to six ring naphthenes, the ratio of the tertiary carbon in the whole carbon constituting the base oil being 6.3 percent or greater. The base oil (X) may be any mineral base oil or synthetic base oil that fulfills the above requirements.

Specific examples of the mineral oil include those which can be obtained by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, hydroisomerization, solvent dewaxing, catalytic dewaxing, and hydrorefining; wax-isomerized mineral oils; and those obtained by isomerizing GTL WAX (Gas to Liquid Wax).

Examples of the synthetic lubricating base oil include polybutenes and hydrogenated compounds thereof; poly-α-olefins such as 1-octene oligomer and 1-decene oligomer, and hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentyl glycol ester, trimethylolpropane caprylate, trimethylolpropane pelargonate, pentaerythritol-2-ethylhexanoate and pentaerythritol pelargonate; aromatic synthetic oils such as alkylnaphthalenes, alkylbenzenes, and aromatic esters; and mixtures of the foregoing.

The kinematic viscosity at 100° C. of the base oil (X) is from 1 to 8 $mm^2/s$, preferably from 2 to 7 $mm^2/s$. The base oil (X) with a kinematic viscosity at 100° C. of greater than 8 $mm^2/s$ is not preferable because the resulting lubricating oil composition would be poor in low temperature viscosity characteristics while the base oil (X) with a kinematic viscosity at 100° C. of less than 1 $mm^2/s$ is not also preferable because the resulting lubricating oil composition would be poor in lubricity due to its insufficient oil film formation at lubricating sites and large in evaporation loss of the lubricating base oil.

The pour point of the base oil (X) is −15° C. or lower, preferably −17.5° C. or lower. There is no particular restriction on the lower limit of the pour point. However, the lower limit is preferably −45° C. or higher, more preferably −30° C. or higher, more preferably −25° C. or higher, particularly preferably −20° C. or higher in view of low temperature viscosity characteristics and economical efficiency of a dewaxing process. The use of the base oil (X) with a pour point of −15° C. or lower renders it possible to produce a lubricating oil composition with excellent low temperature viscosity characteristics. The dewaxing process may be either solvent dewaxing or catalytic dewaxing. However, the dewaxing process is preferably a catalytic dewaxing process because the lower temperature viscosity characteristics can be further improved even though the pour point is made lower than the particularly preferable lower limit, the catalytic dewaxing process renders it possible to produce a lubricating oil composition which is excellent in high-temperature detergency and base number retention properties and can inhibit the increases of the acid number and viscosity in the presence of NOx. A solvent dewaxing process is also preferable because it renders it possible to produce a lubricating oil composition which is excellent in anti-wear properties against wear caused by soot contamination in the composition, soot dispersibility, and sludge dissolubility.

The aniline point of the base oil (X) is preferably 100° C. or higher, more preferably 104° C. or higher, more preferably 108° C. or higher because it renders it possible to produce a lubricating oil composition which can inhibit the increases of the acid number and viscosity more efficiently in the presence of NOx or is excellent in high-temperature detergency and base number retention properties. There is no particular restriction on the upper limit. As one embodiment of the present invention, the aniline point may be 125° C. or higher. However, the aniline point is preferably 125° C. or lower because the resulting composition will be more excellent in soot dispersibility, sludge dissolubility and compatibility with a sealing material.

The paraffin content in the saturates of the base oil (X) is 40 percent by mass or more, preferably 47 percent by mass or more in view of high temperature detergency and base number retention properties and more preferably 50 percent by mass or more, particularly preferably 70 percent by mass of more because it renders it possible to produce a lubricating oil composition which can inhibit the increases of the acid number and viscosity more efficiently in the presence of NOx. There is no particular restriction on the upper limit of the paraffin content. As one embodiment of the present invention, the paraffin content may be 80 percent by mass or more. However, the paraffin content is preferably 80 percent by mass or less and more preferably 70 percent by mass or less in view of more excellent soot dispersibility and sludge dissolubility and more preferably 65 percent by mass or less, more preferably 60 percent by mass or less, particularly preferably 57 percent by mass or less in view of more excellent low temperature viscosity characteristics, high-temperature detergency and base number retention properties and in view of excellent balance of soot dispersibility and sludge dissolubility with the effect of inhibiting the increases of the acid number and viscosity and economical efficiency.

The naphthene content (one to six ring naphthene content) in the saturates of the base oil (X) is 60 percent by mass or less, preferably 53 percent by mass or less, more preferably 50 percent by mass or less, particularly preferably 30 percent by mass or less, correspondingly to the foregoing paraffin content. There is no particular restriction on the lower limit of the naphthene content. As one embodiment of the present invention, the naphthene content may be 20 percent by mass or less. However, the naphthene content is preferably 20 percent by mass or more in view of more excellent soot dispersibility and sludge dissolubility, and more preferably 35 percent by mass or more, more preferably 40 percent by mass or more, more preferably 43 percent by mass or more in view of more excellent low temperature viscosity characteristics, high-temperature detergency and base number retention properties and in view of excellent balance of soot dispersibility and sludge dissolubility with the effect of inhibiting the increases of the acid number and viscosity and economical efficiency.

The one ring naphthene content in the saturates of the base oil (X) is 25 percent by mass or less, preferably 23 percent by mass or less, particularly preferably 15 percent by mass or less. There is no particular restriction on the lower limit. As one embodiment of the present invention, the one ring naphthene content may be less than 5 percent by mass. However, the one ring naphthene content is preferably 5 percent by mass or more, more preferably 10 percent by mass or more, more preferably 15 percent by mass or more in view of excellent soot dispersibility and sludge dissolubility and in view of excellent balance of soot dispersibility and sludge dissolubility with the effect of inhibiting the increases of the acid number and viscosity and economical efficiency.

The two to six ring naphthene content in the saturates of the base oil (X) is 35 percent by mass or less, preferably 32 percent by mass or less, more preferably 28 percent by mass or less, particularly preferably 20 percent by mass or less. There is no particular restriction on the lower limit. As one embodiment of the present invention, the two to six ring naphthene content may be less than 5 percent by mass. However, the two to six ring naphthene content is preferably 5 percent by mass or more in view of more excellent soot dispersibility and sludge dissolubility and more preferably 10 percent by mass or more, more preferably 15 percent by mass or more in view of excellent balance of soot dispersibility and sludge dissolubility with the effect of inhibiting the increases of the acid number and viscosity and economical efficiency.

There is no particular restriction on the total amount of the paraffin and one ring naphthene contents in the saturates of the base oil (X). However, the total amount is preferably 50 percent by mass or more, more preferably 60 percent by mass or more, more preferably 65 percent by mass or more, more preferably 68 percent by mass or more, particularly preferably 72 percent by mass or more. As one embodiment of the present invention, the total amount may be 90 percent by mass or more. However, the total amount is preferably 90 percent by mass or less in view of more excellent soot dispersibility and sludge dissolubility and more preferably 80 percent by mass or less, more preferably 76 percent by mass or less in view of excellent balance of soot dispersibility and sludge dissolubility with the effect of inhibiting the increases of the acid number and viscosity and economical efficiency.

There is no particular restriction on the ratio of the paraffin content to one ring naphthene content in the saturates of the base oil (X) (paraffin content/one ring naphthene content). As one embodiment of the present invention, the ratio may be 10 or greater. However, the ratio is preferably 10 or less in view of more excellent soot dispersibility and sludge dissolubility and more preferably 5 or less, more preferably 3.5 or less, particularly preferably 3 or less in view of excellent low temperature viscosity characteristics.

The paraffin and naphthene contents in the saturates used herein denotes the alkane content (unit: percent by mass) and naphthene content (object to be measured: one to six ring naphthenes, unit: percent by mass) measured in accordance with ASTM D 2786-91.

The ratio of the tertiary carbon in the whole carbon constituting the base oil (X) is necessarily 6.3 percent or greater, preferably 12 percent or less, more preferably from 6.5 to 10 percent, more preferably 6.8 to 9. The ratio of the tertiary carbon within the above ranges renders it possible to produce a lubricating oil composition which is excellent in viscosity-temperature characteristics, high-temperature detergency, and base number retention properties. The ratio of the tertiary carbon is more preferably 7.5 percent or greater in view of more excellent high-temperature detergency and base number retention properties and more preferably 8.3 percent by mass or greater in view of the more excellent effect of inhibiting the increases of the acid number and viscosity in the presence of NOx. The ratio of the tertiary carbon is also more preferably 7.5 percent or less in view of more excellent soot dispersibility and sludge dissolubility and anti-wear properties against wear caused by soot contamination in the oil. The ratio of the tertiary carbon denotes the ratio of the carbon atoms deriving from >CH— in the total amount of the carbon constituting the base oil, i.e., the ratio of the carbon atoms deriving from the branched group or naphthene.

The above-mentioned tertiary carbon ratio denotes the ratio of the total of integrated intensity deriving from the tertiary carbon to the total of integrated intensity of the whole carbons, measured by $^{13}$C-NMR. However, any other method may be used as long as the equivalent result is obtained. In the present invention, the $^{13}$C-NMR measurement was carried out using a sample obtained by diluting 5 g of a sample oil with 3 g of deuterated chloroform at room temperature and resonant frequency of 100 MHz. The measuring method was a gated coupling method.

By the above analysis method, (a) the total integrated intensity at a chemical shift of about 10 to 50 ppm (total integrated intensity deriving from the whole carbons) and (c) the total integrated intensity at chemical shifts of 27.9 to 28.1 ppm, 28.4 to 28.6 ppm, 32.6 to 33.2 ppm, 34.4 to 34.6 ppm, 37.4 to 37.6 ppm, 38.8 to 39.1 ppm and 40.4 to 40.6 ppm (total integrated intensity deriving from the tertiary carbon to which methyl, ethyl and other branched groups are bonded and naphthene tertiary carbon) are measured. When (a) is 100 percent, the ratio of (c) thereto (%) is calculated. The ratio of (c) indicates the ratio of the tertiary carbon to the total amount of the carbons constituting the base oil (X).

There is no particular restriction on the % $C_A$ of the base oil (X). However, the % $C_A$ is preferably 2 or less, more preferably 1 or less, more preferably 0.5 or less, particularly preferably 0.2 or less with the objective of enhancing thermal/oxidation stability, viscosity temperature characteristics, high-temperature detergency and base number retention properties and in view of the more excellent effect of inhibiting the increases of the acid number and viscosity in the presence of NOx. The % $C_A$ is also preferably 0.2 or greater, more preferably 0.5 or greater, particularly preferably 0.8 or greater in view of more excellent soot dispersibility and sludge dissolubility.

There is no particular restriction on the % $C_P$ of the base oil (X). However, the % $C_P$ is preferably 70 or greater, more preferably 75 or greater, more preferably 80 or greater, particularly preferably 85 or greater with the objective of enhancing thermal/oxidation stability, viscosity temperature characteristics, high-temperature detergency and base number retention properties and in view of the more excellent effect of inhibiting the increases of the acid number and viscosity in the presence of NOx. There is no particular restriction on the upper limit of the % $C_P$. As one embodiment of the present invention, the % $C_P$ may be from 90 to 100. However, the % $C_P$ is preferably 90 or less, more preferably 85 or less in view of more excellent soot dispersibility and sludge dissolubility.

There is no particular restriction on the % $C_N$ of the base oil (X). The % $C_N$ is preferably 28 or less, more preferably 25 or less, more preferably 21 or less, particularly preferably 15 or less with the objective of enhancing thermal/oxidation stability, viscosity temperature characteristics, high-temperature detergency and base number retention properties and in view of the more excellent effect of inhibiting the increases of the acid number and viscosity in the presence of NOx. There is no particular restriction on the lower limit of the % $C_N$. As one embodiment of the present invention, the % $C_N$ may be less than 5. However, the % $C_N$ is preferably 5 or greater, more preferably 10 or greater, more preferably 15 or greater in view of more excellent soot dispersibility and sludge dissolubility.

There is no particular restriction on the % $C_P$/% $C_N$ of the base oil (X). The % $C_P$/% $C_N$ is preferably 2 or greater, more preferably 2.5 or greater, more preferably 3.5 or greater, more preferably 4.0 or greater, particularly preferably 6 or greater with the objective of enhancing thermal/oxidation stability and viscosity temperature characteristics and in view of an excellent effect of inhibiting the increases of the acid number and viscosity in the presence of NOx. There is no particular restriction on the upper limit of the % $C_P$/% $C_N$. As one embodiment of the present invention, the % $C_P$/% $C_N$ may be 10 or greater. However, the % $C_P$/% $C_N$ is preferably 10 or less, more preferably 8 or less, more preferably 5 or less, more preferably 4.5 or less in view of more excellent soot dispersibility and sludge dissolubility.

The % $C_A$, % $C_P$, and % $C_N$ used herein denote the percentages of the aromatic carbon number in the total carbon number, the paraffin carbon number in the total carbon number, and the naphthene carbon number in the total carbon number, respectively, determined by a method (n-d-M ring analysis) in accordance with ASTM D 3238-85.

There is no particular restriction on the iodine number of the base oil (X). However, the iodine number is usually 8 or less, preferably 2 or less, more preferably 1 or less, more preferably 0.5 or less, particularly preferably 0.1 or less in view of the more excellent effect of inhibiting the increases of the acid number and viscosity in the presence of NOx. The iodine number is also preferably 0.001 or greater, more preferably 0.01 or greater in view of economical efficiency in the refining process. The "iodine number" used herein denotes the iodine number measured by the indicator titration method in accordance with JIS K 0070 "a method of measuring acid number, saponification number, ester number, iodine number, hydroxyl value, and unsaponifiable matter of chemical products".

There is no particular restriction on the saturate content in the base oil (X). However, the content is preferably 90 percent by mass or more, more preferably 94 percent by mass or more, more preferably 98 percent by mass or more, particularly preferably 99 percent by mass or more, with the objective of further enhancing thermal/oxidation stability, viscosity temperature characteristics, high-temperature detergency and base number retention properties and in view of the more excellent effect of inhibiting the increases of the acid number and viscosity in the presence of NOx.

There is no particular restriction on the aromatic content in the base oil (X). However, the aromatic content is preferably 10 percent by mass or less, more preferably 6 percent by mass or less, more preferably 2 percent by mass or less, particularly preferably 1 percent by mass or less, with the objective of further enhancing thermal/oxidation stability, viscosity temperature characteristics, high-temperature detergency and base number retention properties and in view of the more excellent effect of inhibiting the increases of the acid number and viscosity in the presence of NOx.

The saturate and aromatic contents used herein denote the values (unit: percent by mass) measured in accordance with ASTM D 2007-93.

There is no particular restriction on the sulfur content in the base oil (X). However, the sulfur content is preferably 0.1 percent by mass or less, more preferably 0.05 percent by mass or less, more preferably 0.01 percent by mass or less, particularly preferably 0.001 percent by mass or less.

There is no particular restriction on the nitrogen content in the base oil (X). However, the nitrogen content is preferably 5 ppm by mass or less, more preferably 3 ppm by mass or less because the content renders it possible to produce a lubricating oil composition with more excellent thermal/oxidation stability, high-temperature detergency and base number retention properties and in view of the more excellent effect of inhibiting the increases of the acid number and viscosity in the presence of NOx.

There is no particular restriction on the viscosity index of the base oil (X). However, the viscosity index is preferably 100 or greater, more preferably 110 or greater, more preferably 115 or greater, more preferably 120 or greater, particularly preferably 125 or greater because the content renders it possible to produce a lubricating oil composition with more excellent thermal/oxidation stability, high-temperature detergency and base number retention properties and in view of more excellent effect of inhibiting the increases of the acid number and viscosity in the presence of NOx. As one embodiment of the present invention, the viscosity index may be 135 or greater. However, the viscosity index is preferably 135 or less, more preferably 130 or less in view of more excellent soot dispersibility and sludge dissolubility.

Specific examples of the base oil (X) include the following base oils (X1) to (X3):

(X1) a base oil with a kinematic viscosity at 100° C. of 1 to less than 3.5 $mm^2/s$, preferably 2 to 3 $mm^2/s$, a pour point of −15° C. or lower, and an aniline point of 100° C. or higher, preferably 105° C. or higher, the saturates of the base oil containing 40 percent by mass or more of paraffins, 25 percent by mass or less of one ring naphthenes, and 35 percent by mass or less of two to six ring naphthenes, the ratio of the tertiary carbon in the whole carbon constituting the base oil being 6.3 percent or greater, preferably 7.4 percent or greater;

(X2) a base oil with a kinematic viscosity at 100° C. of 3.5 to less than 5 $mm^2/s$, preferably 3.8 to 4.5 $mm^2/s$, a pour point of −15° C. or lower, and an aniline point of 100° C. or higher, preferably 110° C. or higher, the saturates of the base oil containing 40 percent by mass or more of paraffins, 25 percent by mass or less of one ring naphthenes, and 35 percent by mass or less of two to six ring naphthenes, the ratio of the tertiary carbon in the whole carbon constituting the base oil being 6.3 percent or greater, preferably 7.4 percent or greater; and (X3) a base oil with a kinematic viscosity at 100° C. of 5 to 8 $mm^2/s$, preferably 6 to 7 $mm^2/s$, a pour point of −15° C. or lower, and an aniline point of 100° C. or higher, preferably 115° C. or higher, the saturates of the base oil containing 40 percent by mass or more of paraffins, 25 percent by mass or less of one ring naphthenes, and 35 percent by mass or less of two to six ring naphthenes, the ratio of the tertiary carbon in the whole carbon constituting the base oil being 6.3 percent or greater, preferably 7.4 percent or greater.

In addition to the foregoing properties, these base oils (X1) to (X3) desirably have the above-described various preferable properties exemplified with respect to the base oil (X).

There is no particular restriction on the NOACK evaporation loss of the above (X1) to (X3). However, the NOACK evaporation loss of (X1) is preferably from 25 to 70 percent by mass, more preferably from 30 to 60 percent by mass. The NOACK evaporation loss of (X2) is preferably from 8 to 25 percent by mass, more preferably from 10 to 20 percent by mass, particularly preferably from 10 to 15 percent by mass. The NOACK evaporation loss of (X3) is preferably from 2 to 10 percent by mass, more preferably 4 to 8 percent by mass. The base oils (X1) to (X3) within the above ranges are particularly preferable because high-temperature detergency, base number retention properties, low temperature viscosity characteristics, anti-wear properties and fatigue life or the effect of inhibiting the increases of the acid number and viscosity in the presence of NOx and low temperature viscosity characteristics can be improved in a well-balanced manner. The NOACK evaporation loss used herein denotes the evaporation loss measured in accordance with ASTM D 5800-95.

There is no particular restriction on the iodine number of the above (X1) to (X3). For (X2), the iodine number is preferably 8 or less, more preferably 3 or less, more preferably 2 or less, more preferably 1 or less, more preferably 0.8 or less, more preferably 0.5 or less, particularly preferably 0.1 or less. Further, the iodine number is preferably 0.001 or greater, more preferably 0.01 or greater with the objective of further enhancing the high-temperature detergency and base number retention properties by decreasing the iodine number and in view of economical efficiency in the refining process. For (X1) and (X3), the iodine number is preferably 8 or less, more preferably 6 or less and more preferably from 3 to 6 in view of high-temperature detergency or base number retention properties, the effect of inhibiting the increases of the acid number and viscosity in the presence of NOx and economical efficiency in the refining process. Further, when (X2) is used in combination with (X1) or (X3), the iodine number of the mixed base oil is usually 8 or less. However, the iodine number is preferably 3 or less, more preferably 2.5 or less, more preferably 2 or less with the objective of further enhancing high-temperature detergency or base number retention properties and the effect of inhibiting the increases of the acid number and viscosity in the presence of NOx. The iodine number may be 1 or less but is preferably 1 or greater, more preferably 1.5 or greater in view of the balance with the economical efficiency in the refining process.

The base oil (X) may be a mineral base oil, a synthetic base oil, or a mixed base oil thereof as long as the above-described properties are attained. There is no particular restriction on the method of producing the base oil (X). However, specifically, preferred examples of the lubricating base oil used in the present invention include those produced by subjecting a feedstock selected from the following base oils (1) to (8) and/or a lubricating oil fraction recovered therefrom to a given refining process and recovering the lubricating oil fraction:

(1) a distillate oil produced by atmospheric distillation of a paraffin base crude oil and/or a mixed base crude oil;

(2) a whole vacuum gas oil (WVGO) produced by vacuum distillation of an atmospheric distillation bottom from a paraffin base crude oil and/or a mixed base crude oil;

(3) a wax obtained by a lubricating oil dewaxing process (slack wax) and/or a synthetic wax produced by a gas to liquid (GTL) process (Fischer-Tropsch wax, GTL wax);

(4) one or a mixed oil of two or more oils selected from the base oils (1) to (3) above and/or a mildly-hydrocracked oil of the mixed oil;

(5) a mixed oil of two or more oils selected from the base oils (1) to (4) above;

(6) a deasphalted oil (DAO) obtained by deasphalting the base oil of (1), (2), (3), (4) or (5);

(7) an oil obtained by mildly-hydrocracking (MHC) the base oil (6); and (8) a mixed oil of two or more oils selected from the base oils (1) to (7).

Examples of the above-mentioned process include hydrorefining processes such as hydrocracking and hydrofinishing, solvent refining such as furfural solvent extraction, dewaxing such as solvent dewaxing and catalytic dewaxing, clay refining with acid clay or active clay, and chemical (acid or alkali) treating such as sulfuric acid treating and sodium hydroxide treating. In the present invention, any one or more of these refining processes may be used. When two or more of these refining processes are used in combination, there is no particular restriction on the order thereof. Therefore, the refining processes may be carried out in any order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or

(10) a hydroisomerized mineral oil produced by hydroisomerizing a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

Particularly preferably, the dewaxing treatment carried out upon production of the lubricating base oil (9) or (10) includes a catalytic dewaxing treatment with the objectives of further enhancing the thermal/oxidation stability, low temperature viscosity characteristics, and anti-fatigue properties of the resulting lubricating oil composition.

If necessary, a solvent refining process and/or a hydrofinishing process may be carried out upon production of the lubricating base oil (9) or (10).

There is no particular restriction on the catalyst used in the above-described hydrocracking and hydroisomerizing. However, the catalyst is preferably a hydrocracking catalyst comprising any one of complex oxides having cracking activity (for example, silica-alumina, alumina boria, or silica zirconia) or one or more types of such complex oxides bound with a binder, used as a support and a metal with hydrogenation capability (for example, one or more types of metals of Groups VIa and VIII of the periodic table) supported on the support, or a hydroisomerizing catalyst comprising a support containing zeolite (for example, ZSM-5, zeolite beta, or SAPO-11) and a metal with hydrogenation capability, containing at least one or more types of metals of Group VIII of the periodic table and supported on the support. The hydrocracking and hydroisomerizing catalysts may be laminated or mixed so as to be used in combination.

There is no particular restriction on the conditions under which the hydrocracking and hydroisomerizing are carried out. Preferably, the hydrogen partial pressure is from 0.1 to 20 MPa, the average reaction temperature is from 150 to 450° C., the LHSV is from 0.1 to 3.0 $hr^{-1}$, and the hydrogen/oil ratio is from 50 to 20000 scf/bbl.

The catalytic dewaxing is carried out by reacting a hydrocracked or hydroisomerized oil with hydrogen under conditions effective in reducing the pour point of the oil in the presence of a suitable dewaxing catalyst. The catalytic dewaxing renders it possible to produce two or more types of lubricating base oils by converting a part of the high boiling point substance in the hydrocracked/hydroisomerized product to a low boiling point substance, separating the low boiling point substance from the heavier base oil fraction, and distilling the base oil fraction. The separation of the low boiling point substance may be carried out before obtaining the intended lubricating base oil or during the distillation.

There is no particular restriction on the dewaxing catalyst as long as it can decrease the pour point of the hydrocracked/hydroisomerized oil. However, preferably the catalyst can produce the intended lubricating base oil from the hydrocracked/hydroisomerized oil at a high yield. Preferred examples of such a dewaxing catalyst include shape-selective molecular sieves, more specifically ferrierite, mordenite, ZSM-5, ZSM-11, ZSN-23, ZSM-35, ZSM-22 (also referred to as Theta-1 or TON), and silico-alumino-phosphates (SAPO). The molecular sieves are used in combination with preferably a catalytic metal component, more preferably a precious metal. Preferred combination include complexes of for example platinum and H-mordenite.

There is no particular restriction on the dewaxing conditions. However, preferably the temperature is from 200 to 500° C., and the hydrogen pressure is from 10 to 200 bar (1 MPa to 20 MPa). When a flow-through reactor is used, the $H_2$ treating rate is preferably from 0.1 to 10 kg/l/hr, and the LHSV is preferably from 0.1 to 10 $h^{-1}$, more preferably from 0.2 to 2.0 $h^{-1}$. The dewaxing is preferably carried out so that usually 40 percent by mass or less, preferably 30 percent by mass or less of a substance with an initial boiling point of 350 to 400° C., contained in the hydrocracked/hydroisomerized oil is converted to a substance with a boiling point lower than the initial boiling point.

The lubricating oil composition of the present invention may contain one or more types of base oils selected from those not fulfilling the requirements of the base oil (X) among the above-described mineral base oils and synthetic base oils as long as the composition contains 40 percent by mass or more of the base oil (X). Examples of such base oils include those with a kinematic viscosity at 100° C. of greater than 8 $mm^2/s$, those with an aniline point of lower than 100° C., those the saturates of which contains less than 40 percent by mass of paraffins, those the saturates of which contains more than 25 percent by mass of one ring naphthenes, those the saturates of which contains greater than 35 percent by mass of two to six ring naphthenes, and those wherein the ratio of the tertiary carbon in the whole carbon constituting the base oil is less than 6.3 percent. The mixed ratio of the base oil (X) is preferably 40 percent by mass or more, more preferably 60 percent by mass or more, more preferably 80 percent by mass or more, particularly preferably 100 percent by mass (the lubricating oil consisting of the base oil (X)) on the basis of the total mass of the base oil. The increased mixing ratio of the base oil (X) can provide more excellent high-temperature detergency and base number retention properties and can enhance anti-wear properties against wear caused by soot contamination in the oil and the effect of inhibiting the increases of the acid number and viscosity in the presence of NOx.

The lubricating base oil containing 40 percent by mass or more of the base oil (X) contains preferably the base oils (X2) and/or (X3), particularly preferably (X2) and (X3) because of excellent properties described above and in view of low temperature viscosity characteristics and reduction in evaporation loss. In this case, the mixing ratio of (X2) to (X3) by mass ratio is preferably from 10:90 to 90:10, more preferably from 40:60 to 80:20, more preferably from 60:40 to 75:25. Alternatively, the lubricating base oil (X) preferably contains (X2) as the main component in view of the excellent above-described properties, low temperature viscosity characteristics and a reduction in evaporation loss.

The lubricating base oil containing 40 percent by mass or more of the base oil (X) is so adjusted that the kinematic viscosity at 100° C. is preferably from 3 to 8 $mm^2/s$, more preferably from 4 to 6 $mm^2/s$, more preferably from 4.5 to 5.5 $mm^2/s$ and the viscosity index is preferably 110 or greater, more preferably 115 or greater, more preferably 120 or greater, particularly preferably 125 or greater. There is no particular restriction on the sulfur content of the lubricating base oil containing 40 percent by mass or more of the base oil (X). The sulfur content is preferably 0.3 percent by mass or less but more preferably 0.1 percent by mass or less, more preferably 0.05 percent by mass or less, more preferably 0.005 percent by mass or less with the objective of further enhancing the long service life such as base number retention properties. There is no particular restriction on the NOACK evaporation loss of the lubricating base oil containing 40 percent by mass or more of the base oil (X). However, the NOACK evaporation loss is preferably from 5 to 50 percent by mass, more preferably from 10 to 20 percent by mass, particularly preferably from 12 to 15 percent. There is no particular restriction on the low temperature viscosity characteristics of the lubricating base oil containing 40 percent by mass or more of the base oil (X). However, the CCS viscosity at −30° C. is preferably 20,000 mPa·s or lower, more preferably 7,000 mPa·s or lower, more preferably 3,500 mPa·s or lower. The CCS viscosity denotes the viscosity measured in accordance with JIS K 2010.

Other properties of the lubricating base oil containing 40 percent by mass or more of the base oil (X) are preferably those close to the requirements or preferable requirements of the base oil (X), more preferably those fulfilling a part or more of the requirements of the base oil (X), particularly preferably those fulfilling all of the requirements of the base oil (X).

Component (A) of the present invention is a viscosity index improver.

Examples of Component (A), i.e., viscosity index improver include non-dispersant type and dispersant type viscosity index improvers. Specific examples include non-dispersant type and dispersant type polymethacrylates, non-dispersant type and dispersant type ethylene-α-olefin copolymers and hydrogenated compounds thereof, polyisobutylenes and hydrogenated compounds thereof, styrene-diene hydrogenated copolymers, styrene-maleic anhydride ester copolymers, polymethacrylate-styrene copolymers, polymethacrylate-olefin copolymers, and polyalkylstyrenes.

Specific examples of non dispersant type viscosity index improvers include homopolymers of monomers (hereinafter referred to as "monomer (M-1)") selected from the group consisting of compounds represented by formulas (1) to (3) below, copolymers of two or more monomers (M-1), and hydrogenated compounds thereof:

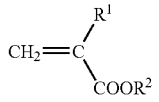

(1)

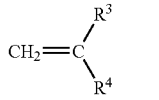

(2)

-continued

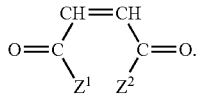

(3)

Specific examples of dispersant type viscosity index improvers include copolymers of two or more monomers (hereinafter referred to as "monomer (M-2)") selected from the group consisting of compounds represented by formulas (4) and (5) below and hydrogenated compounds thereof; and copolymers of one or more monomers (M-1) selected from the group consisting of compounds represented by formulas (1) to (3) above with one or more monomers (M-2) selected from the group consisting of compounds represented by formulas (4) and (5) below and hydrogenated compounds thereof:

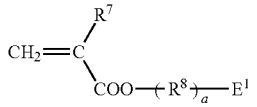

(4)

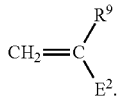

(5)

In formula (1) above, $R^1$ is hydrogen or methyl, and $R^2$ is hydrogen or an alkyl group having 1 to 18 carbon atoms.

Specific examples of alkyl groups having 1 to 18 carbon atoms for $R^2$ include those, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

In formula (2) above, $R^3$ is hydrogen or methyl, and $R^4$ is hydrogen or a hydrocarbon group having 1 to 12 carbon atoms.

Specific examples of hydrocarbon groups having 1 to 12 carbon atoms for $R^4$ include alkyl groups, which may be straight-chain or branched, such as methyl, ethyl, propyl, butyl, pentyl, hexyl, heptyl, octyl, nonyl, decyl, undecyl and dodecyl groups; cycloalkyl groups having 5 to 7 carbon atoms, such as cyclopentyl, cyclohexyl and cycloheptyl groups; alkylcycloalkyl groups, of which the alkyl groups may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; alkenyl groups, which may be straight-chain or branched and the position of which the double bond may vary, such as butenyl, pentenyl, hexenyl, heptenyl, octenyl, nonenyl, decenyl, undecenyl and dodecenyl groups; aryl groups such as phenyl and naphtyl groups; alkylaryl groups, of which the alkyl groups may be straight-chain or branched and bond to any position of the aryl group, having 7 to 12 carbon groups, such as tolyl, xylyl, ethylphenyl, propylphenyl, butylphenyl, pentylphenyl and hexylphenyl groups; and arylalkyl groups, of which the alkyl groups may be straight-chain or branched, having 7 to 12 carbon atoms, such as benzyl, phenylethyl, phenylpropyl, phenylbutyl, phenylpentyl and phenylhexyl groups.

In formula (3) above, $Z^1$ and $Z^2$ are each independently hydrogen, an alkoxy group having 1 to 18 carbon atoms represented by the formula —$OR^5$ wherein $R^5$ is an alkyl group having 1 to 18 carbon atoms, or a monoalkylamino group having 1 to 18 carbon atoms represented by the formula —$NHR^6$ wherein $R^6$ is an alkyl group having 1 to 18 carbon atoms.

In formula (4) above, $R^7$ is hydrogen or methyl, $R^8$ is an alkylene group having 1 to 18 carbon atoms, $E^1$ is an amine residue or heterocyclic residue having 1 or 2 nitrogen and 0 to 2 oxygen, and a is an integer of 0 or 1.

Specific examples of alkylene groups having 1 to 18 carbon atoms for $R^8$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene groups, all of which may be straight-chain or branched.

Specific examples of groups represented by $E^1$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrolidinyl, piperidinyl, quinonyl, pyrrolidonyl, pyrrolidono, imidazolino and pyrazino groups.

In formula (5), $R^9$ is hydrogen or methyl, and $E^2$ is an amine residue or heterocyclic residue having 1 or 2 nitrogen and 0 to 2 oxygen.

Specific examples of groups represented by $E^2$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrolidinyl, piperidinyl, quinonyl, pyrrolidonyl, pyrrolidono, imidazolino and pyrazino groups.

Preferred examples of monomers (M-1) include alkylacrylates having 1 to 18 carbon atoms; alkylmethacrylates having 1 to 18 carbon atoms; olefins having 2 to 20 carbon atoms, styrene, methylstyrene, maleic anhydride ester and maleic anhydride amide, and mixtures thereof.

Preferred examples of monomers (M-2) include dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

There is no particular restriction on the copolymerization molar ratio of the copolymer of monomers (M-1) and (M-2). However, preferably monomer (M-1):monomer (M-2)=80:20 to 95:5. Although no particular restriction is imposed on the copolymerization method, such copolymers are generally obtained with ease by radical-solution polymerization of monomers (M-1) with monomers (M-2) in the presence of a polymerization initiator such as benzoyl peroxide.

As Component (A) used in the present invention, it is necessary to use (a) non-dispersant type olefin (co) polymer viscosity index improver among the above-described viscosity index improvers. The use of (a) non-dispersant type olefin (co)polymer viscosity index improver can provide excellent high-temperature detergency and enhance base number retention properties.

Specific examples of (a) non-dispersant type olefin (co) polymer viscosity index improver include (a1) copolymers containing one type of monomers selected from the group consisting of compounds represented by formula (2) above as the main component and hydrogenated compounds thereof; and (a2) copolymers containing two or more types of monomers selected from the group consisting of compounds represented by formula (2) above as the main component and hydrogenated compounds thereof.

Among these copolymers, preferred examples include copolymers of ethylene represented by formula (2) wherein $R^3$ and $R^4$ are hydrogen and α-olefin represented by formula (2) wherein either one of $R^3$ or $R^4$ is hydrogen and the other is a hydrocarbon group having 1 to 12 carbon atoms, and hydrogenated compounds thereof. Particularly preferred examples include copolymers of ethylene and propylene and hydrogenated compounds thereof.

The PSSI (Permanent Shear Stability Index) of component (a) is usually from 1 to 100 and may be from 50 to 100 in view of excellent effects of enhancing viscosity index and decreasing friction. However, the PSSI is preferably from 1 to 50 in view of excellent shear stability and hardly degrading high-temperature detergency and base number retention properties and preferably from 20 to 50, more preferably from 25 to 45, particularly preferably from 25 to 35 with the objective of further enhancing the viscosity index of the composition. The PSSI used herein denotes the permanent shear stability index of a polymer calculated on the basis of the data measured by the method of ASTM D 6278-02 (Test Method for Shear Stability of Polymer Containing Fluids Using a European Diesel Injector Apparatus) in accordance with ASTM D 6022-01 (Standard Practice for Calculation of Permanent Shear Stability Index).

When component (a) is used alone as Component (A), high-temperature detergency and base number retention properties can be further enhanced, compared with the use of a viscosity index improver other than component (a) (hereinafter referred to as "component (b)") and thus the second object of the present invention can be achieved. Whereas, with regard to the third object, a further improvement must be sought.

Component (a) is preferably used in combination with component (b) as Component (A) in order to achieve the third object of the present invention that high-temperature detergency and base number retention properties are maintained at a higher level while anti-wear properties against wear caused by soot contamination in the lubricating oil is significantly improved.

Specific examples of component (b) include (b1) polymethacrylate viscosity index improvers having a polar group, (b2) olefin (co)polymer viscosity index improvers having a polar group, (b3) polymethacrylate-olefin copolymer viscosity index improvers having a polar group, (b4) polymethacrylate viscosity index improvers having no polar group, and (b5) polymethacrylate-olefin copolymer viscosity index improvers having no polar group.

The polar group used herein denotes a polar group having oxygen atom and/or nitrogen atom bonded to the terminal end of a base monomer such as (meth)acrylate, olefin, and malate, like $Z^1$ and $Z^2$ in formula (3), $E^1$ in formula (4), and $E^2$ in formula (5), specifically a polar group such as alkoxy, alkylamino, amine residue, or heterocyclic residue. In general, viscosity index improvers having such a polar group is referred to as dispersant type viscosity index improver while those not having such a polar group is referred to as non-dispersant type viscosity index improver.

Specific examples of (b1) polymethacrylate viscosity index improvers having a polar group include:

(b1-1) polymers containing one type of monomer selected from the group consisting of compounds represented by formula (4) above, as the main component;

(b1-2) copolymers containing two or more types of monomers selected from the group consisting of compounds represented by formula (4) above, as the main component; and (b1-3) copolymers of a mixture containing one or more type of monomer selected from the group consisting of compounds represented by formula (1) above and one or more type of monomer selected from the group consisting of compounds represented by formula (4) above, as the main component.

Specific examples of (b2) olefin (co)polymer viscosity index improvers having a polar group include:

(b2-1) polymers containing one type of monomer selected from the group consisting of compounds represented by formula (5) above, as the main component;

(b2-2) copolymers containing two or more types of monomers selected from the group consisting of compounds represented by formula (5) above, as the main component; and (b2-3) copolymers of a mixture containing one or more type of monomer selected from the group consisting of compounds represented by formula (2) above and one or more type of monomer selected from the group consisting of compounds represented by formula (5) above, as the main component. Among these, preferred are ethylene-α olefin copolymers having a polar group and hydrogenated compounds thereof, and particularly preferred are ethylene-propylene copolymer having a polar group and hydrogenated compounds thereof.

Specific examples of (b3) polymethacrylate-olefin copolymer viscosity index improvers having a polar group include (b3-1) copolymers of a mixture of one or more type of monomer described with respect to (b1) component and one or more type of monomer described with respect to (b2) component as the main component.

Among these, preferred are polymethacrylate-styrene copolymers having a polar group, polymethacrylates having a polar group, and graft copolymers of olefin (co)polymers and hydrogenated compounds thereof.

Specific examples of (b4) polymethacrylate viscosity index improvers having no polar group include:

(b4-1) polymers containing one type of monomer selected from the group consisting of compounds represented by formula (1) above as the main component; and (b4-2) copolymers containing two or more types of monomers selected from the group consisting of compounds represented by formula (1) above, as the main component.

Specific examples of (b5) polymethacrylate-olefin copolymer viscosity index improvers having no polar group include:

(b5-1) copolymers of one or more type of monomer selected from the group consisting of compounds represented by formula (1) and one or more type of monomer selected from the group consisting of compounds represented by formula (2); and (b5-2) graft copolymer of copolymers of (co)polymers of one or more type of monomer selected from the group consisting of compounds represented by formula (1) and one or more type of monomer selected from the group consisting of compounds represented by formula (2).

Among these, preferred are polymethacrylate-styrene copolymers having no polar group, polymethacrylates having no polar group, and graft copolymers of olefin (co)polymers and hydrogenated compounds thereof.

Preferred examples of component (b) include components (b1) because they are excellent in base number retention properties and particularly excellent in the effect of inhibiting wear caused by soot contamination in the composition, occurring significantly when the amount of ZnDTP is decreased, and one or more types selected from (b2), (b3), (b4) and (b5) because they are excellent in base number retention properties and the effect of inhibiting wear caused by soot contamination in the composition. More preferred examples include one or more types selected from (b2), (b3) and (b4) because they are excellent in base number retention properties and the effect of inhibiting wear caused by soot contamination in the composition in a well-balanced manner.

Component (b) may be of a PSSI of 50 to 100 in view of excellent effects of enhancing viscosity index and decreasing friction. However, the PSSI is preferably from 1 to 50 in view of excellent shear stability and anti-wear properties against wear caused by soot contamination in the composition and hardly degrading high-temperature detergency and base number retention properties and preferably from 20 to 50, more preferably from 30 to 45, particularly preferably from 25 to 35 with the objective of further enhancing the viscosity index of the composition. The PSSI of component (b) is also preferably from 1 to 20, more preferably from 3 to 10, particularly preferably from 4 to 8 with the objective of further enhancing anti-wear properties against wear caused by soot contamination in the composition.

The lubricating oil composition of the present invention necessarily contains component (a) in such an amount that the viscosity index of the composition is to be 140 or greater, preferably 150 or greater, more preferably 160 or greater, particularly preferably 170 or greater with the objective of further enhancing fuel efficiency and viscosity-temperature characteristics due to the increased viscosity index while maintaining high-temperature detergency and base number retention properties. In this case, a significant improvement in high-temperature detergency is attained, compared with a composition containing similarly component (b) alone. The content of component (a) is to be such that the viscosity index of the composition is preferably 250 or less, more preferably 200 or less, more preferably 180 or less because component (a) if contained too much tends to make the shear stability and the base number retention properties poor. Further, the content of component (a) depends on the kinematic viscosity or viscosity index of the lubricating base oil containing 40 percent by mass or more of the base oil (X). However, the content of component (a) is 1 percent by mass or more, preferably 3 percent by mass or more, more preferably 4 percent by mass or more and preferably 20 percent by mass or less in order not to degrade the shear stability, and more preferably 10 percent by mass or less, more preferably 6 percent by mass or less, on the basis of the total mass of the composition, with the objective of further enhancing high-temperature detergency and base number retention properties.

The content of component (b) in the lubricating oil composition of the present invention is usually from 0.01 to 20 percent by mass, but is preferably from 0.1 to 10 percent by mass, more preferably from 0.5 to 5 percent by mass, particularly preferably from 1 to 3 percent by mass in view of excellent high-temperature detergency and base number retention properties and particularly excellent effect of inhibiting wear caused by soot contamination in the composition, occurring significantly when the amount of ZnDTP is decreased.

There is no particular restriction on the content ratio (mass ratio) of component (b) to the total amount of components (a) and (b). However, the content ratio is preferably 0.5 or less, more preferably 0.4 or less, particularly preferably 0.3 or less in view of excellent high-temperature detergency and base number retention properties and is preferably 0.01 or greater, more preferably 0.1 or greater, particularly preferably 0.2 or greater in view of particularly excellent effect of inhibiting wear caused by soot contamination in the composition, significantly occurring when the amount of ZnDTP is decreased.

The lubricating oil composition of the present invention contains, on the basis of the total mass thereof. Component (A) in an amount of 1 to 20 percent by mass, preferably 3 to 15 percent by mass, more preferably 3 to lo percent by mass, particularly preferably 5 to 8 percent by mass, as the amount of component (a) or the total amount of components (a) and (b).

Component (B) used in the present invention is a phosphorus-containing anti-wear agent.

There is no particular restriction on the phosphorus-containing anti-wear agent as long as it contains phosphorus in its molecules. However, the anti-wear agent is preferably one compound selected from the group consisting of phosphorus compounds represented by formulas (6) and (7) below, metal and amine salts thereof, and derivatives thereof:

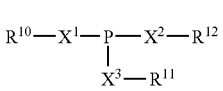

(6)

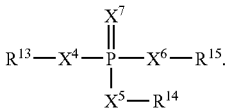

(7)

In formula (6), $X^1$, $X^2$, and $X^3$ are each independently oxygen or sulfur, and $R^{10}$, $R^{11}$, and $R^{12}$ are each independently hydrogen or a hydrocarbon group having 1 to 30 carbon atoms.

In formula (7), $X^4$, $X^5$, $X^6$, and $X^7$ are each independently oxygen or sulfur, (or one or two of $X^4$, $X^5$ and $X^6$ may be a single bond, i.e., P may directly bond to R or a (poly)oxyalkylene group and the other(s) and X7 are oxygen or sulfur), and $R^{13}$, $R^{14}$, and $R^{15}$ are each independently hydrogen or a hydrocarbon group having 1 to 30 carbon atoms.

Examples of the hydrocarbon groups having 1 to 30 carbon atoms for $R^{10}$ to $R^{15}$ include alkyl, cycloalkyl, alkenyl, alkyl-substituted cycloalkyl, aryl, alkyl-substituted aryl, and arylalkyl groups. The hydrocarbon groups are preferably alkyl groups having 1 to 30 carbon atoms and aryl groups having 6 to 24 carbon atoms, more preferably alkyl groups having 3 to 18 carbon atoms, more preferably alkyl groups having 4 to 12 carbon atoms. These hydrocarbon groups may contain oxygen, nitrogen, or sulfur in their molecules but desirably contain carbon and hydrogen only.

Examples of phosphorus compounds represented by formula (6) include phosphorous acid; monothiophosphorus acid; dithiophosphorus acid; trithiophosphorus acid; phosphorus acid monoesters, monothiophosphorus acid monoesters, dithiophosphorus acid monoesters, and trithiophosphorus acid monoesters, each having one of the above-described hydrocarbon groups having 1 to 30 carbon atoms; phosphorus acid diesters, monothiophosphorus acid diesters, dithiophosphorus acid diesters, and trithiophosphorus acid diesters, each having two of the above-described hydrocarbon groups having 1 to 30 carbon atoms; phosphorus acid triesters, monothiophosphorus acid triesters, dithiophosphorus acid triesters, and trithiophosphorus acid triesters, each having three of the above-described hydrocarbon groups having 1 to 30 carbon atoms; and mixtures thereof.

Examples of phosphorus compounds represented by formula (7) include phosphoric acid; monothiophosphoric acid; dithiophosphoric acid; trithiophosphoric acid; tetrathiophosphoric acid; phosphoric acid monoesters, monothiophosphoric acid monoesters, dithiophosphoric acid monoesters, trithiophosphoric acid monoesters, and tetrathiophosphoric acid monoesters, each having one of the above-described hydrocarbon groups having 1 to 30 carbon atoms; phosphoric acid diesters, monothiophosphoric acid diesters, dithiophosphoric acid diesters, trithiophosphoric acid diesters, and tetrathiophosphoric acid diesters, each having two of the above-described hydrocarbon groups having 1 to 30 carbon atoms; phosphoric acid triesters, monothiophosphoric acid triesters, dithiophosphoric acid triesters, trithiophosphoric acid triesters, and tetrathiophosphoric acid triesters, each having three of the above-described hydrocarbon groups having 1 to 30 carbon atoms; phosphonic acid, phosphonic acid monoesters, and phosphonic acid diesters, each having one to three of the above-described hydrocarbon groups having 1 to 30 carbon atoms; the phosphoric acid compounds exemplified above but having a (poly)oxyalkylene group having 1 to 4 carbon atoms; derivatives of the phosphorous compounds exemplified above, such as β-dithiophosphorylated propionic acid and reaction products of dithiophosphates and olefin cyclopentadiene or (methyl)methacrylates; and mixtures thereof.

Examples of salts of phosphorus compounds represented by formulas (6) and (7) include salts obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound and neutralize the whole or part of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkaline earth metals such as magnesium and calcium, and zinc.

Specific examples of the nitrogen-containing compound include ammonia, monoamines, diamines, and polyamines. Specific examples include amine compounds constituting amine complexes of molybdenum described below with respect to Component (E).

Among these nitrogen-containing compounds, preferred examples include aliphatic amines having an alkyl or alkenyl group having 10 to 20 carbon atoms, which may be straight-chain or branched, such as decylamine, dodecylamine, dimethyldodecylamine, tridecylamine, heptadecylamine, octadecylamine, oleylamine, and stearyl amine.

Particularly preferably, the lubricating oil composition of the present invention contains Component (B) containing at least one type selected from the following (B1) to (B3) as the above-described phosphorus-containing anti-wear agent:

(B1) zinc dialkyldithiophosphates having a secondary alkyl group selected from those having 3 to 8 carbon atoms;

(B2) zinc dialkyldithiophosphates having a primary alkyl group selected from those having 3 to 8 carbon atoms; and (B3) metal salts of phosphorus-containing acids containing no sulfur.

Examples of Components (B1) and (B2) include those represented by formula (8) below:

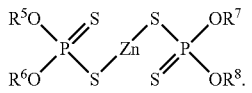

(8)

In formula (8), $R^5$, $R^6$, $R^7$, and $R^8$ may be the same or different from each other and are each independently a secondary or primary alkyl group having 3 to 8 carbon atoms, preferably a secondary alkyl group having 3 to 6 carbon atoms or a primary alkyl group having 6 to 8 carbon atoms and may have in the same molecule alkyl group of different carbon number or different structure (secondary, primary).

In the present invention, the lubricating oil composition contains preferably Component (B1) because it is likely to inhibit wear caused by soot contamination in the composition even though the concentration of Component (B1), also preferably Component (B2) because it can enhance oxidation stability and base number retention properties significantly, and also most preferably Components (B1) and (B2) in combination because they can enhance the effect of inhibiting wear caused by soot contamination in the composition and base number retention properties at a higher level in a well-balanced manner.

There is no particular restriction on the method of producing zinc dithiophosphate since any conventional method may be employed. For example, zinc dithiophosphate may be synthesized by reacting alcohol having an alkyl group corresponding to the above $R^5$, $R^6$, $R^7$, and $R^8$ with diphosphorus pentasulfide thereby producing dithiophosphoric acid, which is then neutralized with zinc oxide.

Component (B3) is a metal salt of a phosphorus-containing acid containing no sulfur. Typical examples include metal salts of phosphorus compounds represented by formula (6) wherein all of the $X^1$ to $X^3$ are oxygen (one or two of $X^1$, $X^2$ and $X^3$ may be a single bond or a (poly)oxyalkylene group) and metal salts of phosphorus compounds represented by formula (7) wherein all of the $X^4$ to $X^7$ are oxygen (one or two of $X^4$, $X^5$ and $X^6$ may be a single bond or a (poly)oxyalkylene group). Components (B3) is preferably used because they can significantly enhance long-drain properties such as high-temperature detergency, oxidation stability and base number retention properties.

The above-described metal salts of phosphorus compounds vary in structure depending on the valence of metals and the number of OH or SH group of the phosphorus compounds. Therefore, there is no particular restriction on the structure of the metal salts of phosphorus compounds. For example, when 1 mol of zinc oxide is reacted with 2 mol of a phosphoric acid monoester (with one OH group), it is assumed that a compound with a structure represented by formula (9) below is obtained as the main component but polymerized molecules may also exist:

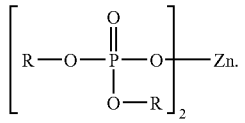

(9)

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

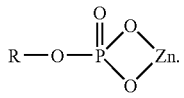

(10)

Preferred examples of Component (B3) include salts of phosphorus acid diesters having two alkyl or aryl groups having 3 to 18 carbon atoms and zinc; salts of phosphoric acid monoesters having one alkyl or aryl group having 3 to 18 carbon atoms and zinc; salts of phosphoric acid diesters having two alkyl or aryl groups having 3 to 18 carbon atoms and zinc; and salts of phosphonic acid monoesters having two alkyl or alkenyl groups having 1 to 18 carbon atoms and zinc. These components may be used alone or in combination.

The upper limit content of the phosphorus-containing anti-wear agent, preferably one type selected from Components (B1), (B2) and (B3) in the lubricating oil composition is 0.2 percent by mass or less, preferably 0.1 percent by mass or less, more preferably 0.08 percent by mass or less, particularly preferably 0.06 percent by mass or less in terms of phosphorus. The lower limit content is 0.01 percent by mass or more, preferably 0.02 percent by mass or more, particularly preferably 0.04 percent by mass or more in terms of phosphorus with the objective of easily inhibiting wear caused by soot contamination in the composition.

When Components (B1) and (B2) are used in combination, they are each contained in an amount of 0.01 to 0.04 percent by mass, preferably 0.02 to 0.03 percent by mass in terms of phosphorus and in an amount of 0.02 to 0.08 percent by mass, more preferably 0.04 to 0.06 percent by mass in terms of total phosphorus.

When the content of the phosphorus-containing anti-wear agent is in excess of 0.2 percent by mass, it is not preferable because it makes high-temperature detergency and base number retention properties significantly poor. The content of 0.09 to 0.2 percent by mass is preferable because no significant wear occurs even when soot contaminates the composition. However, the content is desirably 0.08 percent by mass or less with the objective of further enhancing high-temperature detergency and base number retention properties.

Component (C) of the lubricating oil composition of the present invention is a metallic detergent. Specific examples of the metallic detergent include sulfonate, phenate, salicylate, and carboxylate detergents, any of which may be used. In the present invention, it is particularly preferred to use a salicylate detergent because its excellent high-temperature detergency and particularly excellent base number retention properties.

There is no particular restriction on the structure of the sulfonate detergent. Examples of the sulfonate detergent include alkali metal or alkaline earth metal salts, particularly preferably magnesium and/or calcium salts, of alkyl aromatic sulfonic acids, obtained by sulfonating alkyl aromatic compounds having a molecular weight of 100 to 1,500, preferably 200 to 700. Specific examples of the alkyl aromatic sulfonic acids include petroleum sulfonic acids and synthetic sulfonic acids. The petroleum sulfonic acids may be those obtained by sulfonating an alkyl aromatic compound contained in the lubricant fraction of a mineral oil or may be mahogany acid by-produced upon production of white oil. The synthetic sulfonic acids may be those obtained by sulfonating an alkyl benzene having a straight-chain or branched alkyl group, produced as a by-product from a plant for producing an alkyl benzene used as the raw material of a detergent or obtained by alkylating polyolefin to benzene, or those obtained by sulfonating dinonylnaphthalene. There is no particular restriction on the sulfonating agent used for sulfonating these alkyl aromatic compounds. The sulfonating agent may be fuming sulfuric acids or sulfuric acid.

The sulfonate detergents include not only neutral alkaline earth metal sulfonates produced by reacting the above-mentioned alkyl aromatic sulfonic acid directly with an alkaline earth metal base such as an oxide or hydroxide of an alkaline earth metal such as magnesium and/or calcium or produced by once converting the alkyl aromatic sulfonic acid to an alkali metal salt such as a sodium salt or a potassium salt and then substituting the alkali metal salt with an alkaline earth metal salt; but also basic alkaline earth metal sulfonates produced by heating such neutral alkaline earth metal salts and an excess amount of an alkaline earth metal salt or an alkaline earth metal base (hydroxide or oxide) in the presence of water; and carbonate overbased alkaline earth metal sulfonates and borate overbased alkaline earth metal sulfonates produced by reacting such neutral alkaline earth metal sulfonates with an alkaline earth metal base in the presence of carbonic acid gas and/or boric acid or borate.

The sulfonate detergent used in the present invention may be any of the above-described neutral, basic and overbased alkaline earth metal sulfonates and mixtures thereof.

The sulfonate detergent is preferably a calcium sulfonate detergent or a magnesium sulfonate detergent, particularly preferably a calcium sulfonate detergent.

Although sulfonate detergents are usually commercially available as diluted with a light lubricating base oil, it is preferred to use a sulfonate detergent whose metal content is from 1.0 to 20 percent by mass, preferably from 2.0 to 16 percent by mass.

The base number of the sulfonate detergent used in the present invention is optional and usually from 0 to 500 mgKOH/g. However, the base number is preferably from 100 to 450 mgKOH/g, more preferably from 200 to 400 mgKOH/g because of excellent effect of improving high-temperature detergency per content.

The term "base number" used herein denotes the base number measured by the perchloric acid potentiometric titration method in accordance with section 7 of JIS K2501 "Petroleum products and lubricants-Determination of neutralization number".

There is no particular restriction on the structure of the salicylate detergent. However, the salicylate detergent is preferably a metal salt, preferably alkali metal or alkaline earth metal salt, particularly preferably magnesium and/or calcium salt of an salicylic acid having one or two alkyl groups having 1 to 40 carbon atoms.

The salicylate detergent used in the present invention is preferably that the component ratio of which monoalkylsalicylic acid metal salt is higher because of its excellent low temperature viscosity characteristics and thus for example is preferably an alkylsalicylic acid metal salt and/or an (overbased) basic salt thereof, the component ratios of which monoalkylsalicylic acid metal salt and dialkylsalicylic acid metal salt are from 85 to 100 percent by mole and from 0 to 15 percent by mole respectively, and the component ratio of which 3-alkylsalicylic acid metal salt is from 40 to 100 percent by mole. The salicylate detergent is preferably that containing a dialkyl salicylic acid metal salt because of its excellent high-temperature detergency and base number retention properties.

The term "monoalkylsalicylic acid metal salt" used herein denotes an alkylsalicylic acid having one alkyl group, such as 3-alkylsalicylic acid metal salt, 4-alkylsalicylic acid metal salt, and 5-alkylsalicylic acid metal salt. The component ratio of the monoalkylsalicylic acid metal salt is from 85 to 100 percent by mole, preferably from 88 to 98 percent by mole, more preferably from 90 to 95 percent by mole, on the basis of 100 percent by mole of the alkylsalicylic acid metal salt. The component ratio of the alkylsalicylic acid metal salt other than monoalkylsalicylic acid metal salt, such as dialkylsalicylic acid metal salt is from 0 to 15 percent by mole, preferably from 2 to 12 percent by mole, more preferably from 5 to 10 percent by mole. The component ratio of the 3-alkylsalicylic acid metal salt is from 40 to 100 percent by mole, preferably from 45 to 80 percent by mole, more preferably from 50 to 60 percent by mole, on the basis of 100 percent by mole of the alkylsalicylic acid metal salt. The total component ratio of the 4-alkylsalicyclic acid metal salt and 5-alkylsalicylic acid metal salt corresponds to the component ratio of the alkylsalicylic acid metal salt excluding the 3-alkylsalicylic acid metal salt and dialkylsalicylic acid metal salt and is from 0 to 60 percent by mole, preferably from 20 to 50 percent by mole, more preferably from 30 to 45 percent by mole, on the basis of 100 percent by mole of the alkylsalicylic acid metal salt. Inclusion of a slight amount of the dialkylsalicylic acid metal salt renders it possible to produce a composition which is excellent in high-temperature detergency and low temperature characteristics as well as base number retention properties. The component ratio of the 3-alkylsalicylate of 40 percent by mole or more renders it possible to reduce relatively the component ratio of the 5-alkylsalicylic acid metal salt and thus enhance the oil solubility.

Examples of the alkyl group of the alkylsalicylic acid metal salt constituting the salicylate detergent include alkyl groups having 10 to 40, preferably 10 to 19 or 20 to 30, more preferably 14 to 18 or 20 to 26, particularly preferably 14 to 18 carbon atoms. Examples of alkyl groups having 10 to 40 carbon atoms include those such as decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and primary and secondary alkyl groups. However, secondary alkyl groups are preferable with the objective of easily producing the above-described desired salicylic acid metal salt.

Examples of the metal of the alkylsalicylic acid metal salt include alkali metals such as sodium and potassium, and alkaline earth metals such as calcium and magnesium. The metal is preferably calcium or magnesium, particularly preferably calcium.

There is no particular restriction on the method of producing the salicylate detergent used in the present invention which thus may be produced by any of the known methods. For example, an alkylsalicylic acid containing a monoalkylsalicylic acid as the main component is obtained by alkylating 1 mole of a phenol using 1 mole or more of an olefin having 10 to 40 carbon atoms, such as a polymer or copolymer of ethylene, propylene, or butene, preferably a straight-chain $\alpha$-olefin such as an ethylene polymer, and then carboxylating the alkylated phenol using carbon dioxide gas, or alternatively by alkylating 1 mole of salicylic acid using 1 mole or more of such an olefin preferably such a straight-chain $\alpha$-olefin. The alkylsalicylic acid is then reacted with a metal base such as an alkali metal or alkaline earth metal oxide or hydroxide or converted to an alkali metal salt such as sodium salt or potassium salt, which alkali metal salt may be further substituted with an alkaline earth metal. Particularly preferably, the reaction ratio of the phenol or salicylic acid to the olefin is adjusted to preferably 1:1 to 1.15 (molar ratio), more preferably 1:1.05 to 1.1 (molar ratio) because the component ratio of the monoalkylsalicylic acid metal salt to dialkylsalicylic acid metal salt is easily adjusted to the desired ratio required by the present invention. Further, particularly preferably a straight-chain α-olefin is used as the olefin because the component ratio of the 3-alkylsalicylic acid metal salt, 5-alkylsalicylic acid metal salt, or the like is easily adjusted to the desired ratio required by the present invention, and an alkylsalicylic acid metal salt having a secondary alkyl group which is preferable in the present invention can be obtained as the main component. The use of a branched olefin as the above-mentioned olefin is not preferable because only the 5-alkylsalicylic acid metal salt is easily obtainable, but it is necessary to improve the oil solubility by mixing the 3-alkylsalicylic acid metal salt so as to obtain a salicylate detergent with the structure desired by the present invention, making the process variable.

The salicylate detergent used in the present invention also includes basic salts produced by heating an alkali metal or alkaline earth metal salicylate (neutral salt) obtained as described above, and an excess amount of an alkali metal or alkaline earth metal salt or an alkali metal or alkaline earth metal base (hydroxide or oxide of an alkali metal or alkaline earth metal) in the presence of water; and overbased salts produced by reacting such a neutral salt with a base such as a hydroxide of an alkali metal or alkaline earth metal in the presence of carbonic acid gas and/or boric acid or borate.

These reactions are generally carried out in a solvent (aliphatic hydrocarbon solvents such as hexane, aromatic hydrocarbon solvents such as xylene, and light lubricating base oil). It is preferred to use a solvent whose metal content is within the range of 1.0 to 20 percent by mass, preferably 2.0 to 16 percent by mass.

Most preferable salicylate detergents used in the present invention are alkylsalicylic acid metal salts and/or (overbased) basic salts thereof, the component ratios of which monoalkylsalicylic acid metal salt and dialkylsalicylic acid metal salt are from 85 to 95 percent by mole and from 5 to 15 percent by mole respectively, and 3-alkylsalicylic acid metal salt, and 4-alkylsalicylic acid metal salt and 5-alkylsalicylic acid metal salt are from 50 to 60 percent by mole and from 35 to 45 percent by mole respectively, because they are excellent in balance of high-temperature detergency, base number retention properties and low temperature viscosity characteristics. The alkyl group referred herein is particularly preferably a secondary alkyl group.

The base number of the salicylate detergent used in the present invention is usually from 0 to 500 mgKOH/g, preferably from 20 to 300 mgKOH/g, particularly preferably from 100 to 200 mgKOH/g. One or more of the salicylate detergents with a base number in these ranges may be used. The term "base number" used herein denotes a base number measured by the perchloric acid potentiometric titration method in accordance with section 7 of JIS K2501 "Petroleum products and lubricants-Determination of neutralization number".

Specific examples of the phenate detergent include alkaline earth metal salts, particularly magnesium salts and/or calcium salts, of an alkylphenolsulfide obtained by reacting an alkylphenol having at least one straight-chain or branched alkyl group having 4 to 40, preferably 6 to 18 carbon atoms with sulfur or a Mannich reaction product of an alkylphenol obtained by reacting such an alkylphenol with formaldehyde.

The phenate detergent used in the present invention also includes basic salts produced by heating an alkali metal or alkaline earth metal phenate (neutral salt) obtained as described above, and an excess amount of an alkali metal or alkaline earth metal salt or an alkali metal or alkaline earth metal base (hydroxide or oxide of an alkali metal or alkaline earth metal) in the presence of water; and overbased salts produced by reacting such a neutral salt with a base such as a hydroxide of an alkali metal or alkaline earth metal in the presence of carbonic acid gas and/or boric acid or borate.

These reactions are generally carried out in a solvent (aliphatic hydrocarbon solvents such as hexane, aromatic hydrocarbon solvents such as xylene, and light lubricating base oil). It is preferred to use a solvent whose metal content is within the range of 1.0 to 20 percent by mass, preferably 2.0 to 16 percent by mass.

The base number of the phenate detergent is usually from 0 to 500 mgKOH/g, preferably from 20 to 450 mgKOH/g.

There is no particular restriction on the metal ratio of these metallic detergents, which is usually from 1 to 40. In the present invention, it is preferred to blend at least one type of metallic detergent with a metal ratio of preferably 2 or greater, more preferably 2.5 or greater, with the objective of easily inhibit wear caused by soot contamination in the composition. In view of safety, the metal ratio is preferably 20 or less, more preferably 15 or less, more preferably 10 or less, particularly preferably 5 or less. The term "metal ratio" used herein is represented by "valence of metal element×metal element content (mol %)/soap group content (mol %) in a metallic detergent". The "soap group" denotes the opposite organic group forming the metal salt and is a sulfonic acid-containing group, a salicylic acid-containing group, or a phenol-containing group.

The content of Component (C) in the lubricating oil composition of the present invention is from 0.01 to 1 percent by mass, preferably from 0.05 to 0.5 percent by mass, more preferably from 0.1 to 0.3 percent by mass, more preferably from 0.15 to 0.25 percent by mass in terms of metal.

Component (D) of the present invention is an ashless antioxidant. Preferred examples of Component (D) include phenolic and aminic anti-oxidants.

Specific examples of the phenolic anti-oxidants include those containing no sulfur as a constituent, such as 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), octyl-3-(3,5-di-tert-butyl-4-hydroxyphenyl)propionate, tridecyl-3-(3,5-di-tert-butyl-4-hydroxyphenyl)propionate, pentaerythrityl-tetraquis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate, and octyl-3-(3-methyl-5-tert-butyl-4-hydroxyphenyl)propionate; those containing sulfur as a constituent, such as 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, and 2,2'-thiodiethylenebis[3-(3,5-di-tert-butyl-4-hydroxyphenyl) propionate]; and mixtures thereof. Among these, preferred examples include hydroxyphenyl-substituted fatty acid ester-based anti-oxidants that are esters of hydroxyphenyl group-substituted fatty acids and alcohols having 4 to 12 carbon atoms, (octyl-3-(3,5-di-tert-butyl-4-hydroxyphenyl)propionate, octyl-3-(3-methyl-5-tert-butyl-4-hydroxyphenyl)propionate) and bisphenolic ashless anti-oxidants. More preferred examples include hydroxyphenyl-substituted fatty acid ester-based anti-oxidants. Phenolic compounds with a molecular weight of 240 or greater are also preferable because they are high in decomposition temperature and thus can exhibit their effects under higher temperature conditions.

Specific examples of the aminic ashless dispersants include phenyl-α-naphtylamines, alkylphenyl-α-naphtylamines, alkyldiphenylamines, dialkyldiphenylamines, N,N'-diphenyl-p-phenylene diamine, and mixtures thereof. The alkyl groups of these aminic ashless anti-oxidants are preferably straight-chain or branched alkyl groups having 1 to 20 carbon atoms, more preferably straight-chain or branched alkyl groups having 4 to 12 carbon atoms.

There is no particular restriction on the content of Component (D). However, the content is preferably 0.01 percent by mass or more, more preferably 0.1 percent by mass or more, more preferably 0.5 percent by mass or more, particularly preferably 1.0 percent by mass or more and preferably 5 percent by mass or less, more preferably 3 percent by mass or less, particularly preferably 2 percent by mass or less on the basis of the total mass of the composition. Component (D) of less than 0.01 percent is not preferable because the effect of inhibiting the increase of acid number and viscosity in the presence of NOx tends to be insufficient. Component (D) of more than 5 percent by mass tends to make the storage stability of the lubricating oil composition poor.

In the present invention, the phenolic ashless dispersant in an amount of 0.4 to 2 percent by mass, preferably 0.6 to 1.5 percent by mass and the aminic ashless dispersant in an amount of 0.4 to 2 percent by mass, preferably 0.6 to 1.5 percent by mass are particularly preferably used alone or in combination.

Component (E) of the present invention is an organic molybdenum compound.

Examples of the organic molybdenum compound include those containing sulfur such as molybdenum dithiophosphate and molybdenum dithiocarbamate.

Examples of molybdenum dithiophosphate include compounds represented by formula (11) below:

(11)

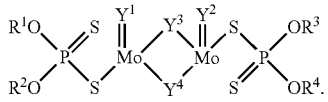

In formula (11), $R^1$, $R^2$, $R^3$, and $R^4$ may be the same or different from each other and a hydrocarbon group such as alkyl groups having 2 to 30, preferably 5 to 18, and more preferably 5 to 12 carbon atoms and an (alkyl)aryl group having 6 to 18 and preferably 10 to 15 carbon atoms, and $Y^1$, $Y^2$, $Y^3$, and $Y^4$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position.

Specific examples of molybdenum dithiophophates include sulfurized molybdenum diethyldithiophosphate, sulfurized molybdenum dipropyldithiophosphate, sulfurized molybdenum dibutyldithiophosphate, sulfurized molybdenum dipentyldithiophosphate, sulfurized molybdenum dihexyldithiophosphate, sulfurized molybdenum dioctyldithiophosphate, sulfurized molybdenum didecyldithiophosphate, sulfurized molybdenum didodecyldithiophosphate, sulfurized molybdenum di(butylphenyl) dithiophosphate, sulfurized molybdenum di(nonylphenyl) dithiophosphate, sulfurized oxymolybdenum diethyldithiophosphate, sulfurized oxymolybdenum dipropyldithiophosphate, sulfurized oxymolybdenum dibutyldithiophosphate, sulfurized oxymolybdenum dipentyldithiophosphate, sulfurized oxymolybdenum dihexyldithiophosphate, sulfurized oxymolybdenum dioctyldithiophosphate, sulfurized oxymolybdenum didecyldithiophosphate, sulfurized oxymolybdenum didodecyldithiophosphate, sulfurized oxymolybdenum di(butylphenyl)dithiophosphate, sulfurized oxymolybdenum di(nonylphenyl)dithiophosphate, all of which the alkyl groups may be straight-chain or branched and the alkyl groups may bond to any position of the alkylphenyl groups, and mixtures thereof. Furthermore, the molybdenum dithiophosphate may be those having in per molecule hydrocarbon groups each having a different carbon number and/or structure from each other.

Examples of molybdenum dithiocarbamate include compounds represented by formula (12) below:

(12)

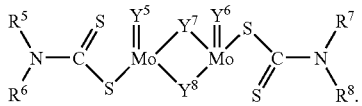

In formula (12), $R^5$, $R^6$, $R^7$, and $R^8$ may be the same or different from each other and a hydrocarbon group such as alkyl groups having 2 to 24, preferably 4 to 13 and (alkyl)aryl group having 6 to 24 and preferably 10 to 15 carbon atoms, and $Y^5$, $Y^6$, $Y^7$, and $Y^8$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position. Examples of molybdenum dithiocarbamates with structures other than those described above include those having a structure that a thio- or polythio-trinuclear molybdenum comprises bonded thereto ligands such as dithiocarbamates, as disclosed in WO98/26030 and WO99/31113.

Specific examples of the molybdenum dithiocarbamates include sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum di(butylphenyl) dithiocarbamate, sulfurized molybdenum di(nonylphenyl) dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched and the alkyl groups may bond to any position of the alkylphenyl groups, and mixtures thereof. Furthermore, the molybdenum dithiocarbamate may be those having in one molecule hydrocarbon groups each having a different carbon number and/or structure from each other.

Examples of sulfur-containing organic molybdenum compounds other than those exemplified above include complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiuramdisulfide, bis(di(thio)hydrocarbyldithiophosphonate) disulfide, organic (poly)sulfide, and sulfurized esters) or other organic compounds; complexes of sulfur-containing molybdenum compounds such as the above-mentioned molybdenum sulfides and sulfurized molybdenum acid and sulfur-free organic compounds such as amine compounds, succinimide, organic acids, and alcohols, described below with respect to the organic compounds containing no sulfur as a constituent; and sulfur-containing organic molybdenum compounds produced by reacting the molybdenum compounds containing no sulfur as a constituent described below, the above-mentioned sulfur-free organic compounds, and sulfur sources (elemental sulfur, hydrogen sulfide, phosphorus pentasulfide, sulfur oxide, inorganic sulfides, hydrocarbyl (poly)sulfides, sulfurized olefins, sulfurized esters, sulfurized waxes, sulfurized carboxylic acids, sulfurized alkylphenols, thioacetamide, and thiourea). The method of producing these sulfur-containing organic molybdenum compounds are described in Japanese Patent Laid-Open Publication No. 56-10591 and U.S. Pat. No. 4,263,152 in detail.

Alternatively, Component (E) may be an organic molybdenum compound containing no sulfur as a constituent.

Specific examples of the organic molybdenum compounds containing no sulfur as a constituent include molybdenum-amine complexes, molybdenum-succinimide complexes, molybdenum salts of organic acids, and molybdenum salts of alcohols. Preferred examples include molybdenum-amine complexes, molybdenum salts of organic acids, and molybdenum salts of alcohols.

Examples of molybdenum compounds constituting the above-mentioned molybdenum-amine complexes include molybdenum compounds containing no sulfur such as molybdenum trioxide and hydrate thereof ($MoO_3.nH_2O$), molybdic acids ($H_2MoO_4$), alkali metal salts of molybdic acids ($M_2MoO_4$, wherein M indicates an alkali metal), ammonium molybdate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, and $Mo_2O_3Cl_6$. Among these, preferred are hexavalent molybdenum compounds in view of the yield of the molybdenum-amine complexes. More preferred among the hexavalent molybdenum compounds are molybdenum trioxide and hydrate thereof, molybdic acids, alkali metal salts of molybdic acids and ammonium molybdate in view of availability.

There is no particular restriction on the amine compound constituting the molybdenum-amine complex. Specific examples of nitrogen compounds include monoamines, diamines, polyamines, and alkanolamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, such as undecyldiethylamine, undecyldiethanolamine, dodecyldipropanolamine, oleyldiethanolamine, oleylpropylenediamine, and stearyltetraethylenepentamine and imidazoline; alkyleneoxide adducts thereof; and mixtures thereof among these amine compounds, preferred examples include primary amines, secondary amines, and alkanolamines.

The carbon number of the amine compound constituting the molybdenum-amine complex is preferably 4 or greater, more preferably from 4 to 30, particularly preferably from 8 to 18. An amine compound having fewer than 4 carbon atoms would tend to be poor in dissolubility. The use of an amine compound having 30 or fewer carbon atoms can relatively increase the content of molybdenum in the molybdenum-amine complex, enabling the advantageous effects of the present invention to enhance even if the complex is added in a small amount.

Examples of the molybdenum-succinimide complex include complexes of the molybdenum compounds containing no sulfur exemplified with respect to the above molybdenum-amine complex and succinimides having an alkyl or alkenyl group having 4 or more carbon atoms. Examples of the succinimides include succinimides having in their molecules at least one alkyl or alkenyl group having 40 to 400 carbon atoms and derivatives thereof as exemplified with respect to the ashless dispersant described below and those having an alkyl or alkenyl group having 4 to 39, preferably 8 to 18 carbon atoms. A succinimide having fewer than 4 carbon atoms would tend to be poor in dissolubility. A succinimide having an alkyl or alkenyl group having more than 30 but 400 or fewer carbon atoms may be used. However, the use of a succinimide having 30 or fewer carbon atoms can relatively increase the content of molybdenum in the molybdenum-amine complex, enabling the advantageous effects of the present invention to enhance even if the complex is added in a small amount.

Examples of the molybdenum salts of organic acids include salts of molybdenum bases such as molybdenum oxide or hydroxide exemplified with respect to the molybdenum-amine complex, molybdenum carbonate and molybdenum chlorides and organic acids. The organic acids are preferably sulfur-free phosphorus-containing acids exemplified with respect to Component (B3) or carboxylic acids.

The carboxylic acid constituting the molybdenum salt of a carboxylic acid may be a monobasic acid or a polybasic acid.

Examples of the monobasic acid include fatty acids having usually 2 to 30, preferably 4 to 24 carbon atoms, which may be straight-chain or branched and saturated or unsaturated. Specific examples include saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanonic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid, and straight-chain or branched tetracosanoic acid; unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenic acid, straight-chain or branched heneicosenic acid, straight-chain or branched docosenic acid, straight-chain or branched tircosenic acid, and straight-chain or branched tetracosenic acid; and mixtures thereof.

Other than the above-exemplified fatty acids, the monobasic acid may be a monocylic or polycyclic carboxylic acid (may have a hydroxyl group). The carbon number of the monocylic or polycyclic carboxylic acid is preferably from 4 to 30, more preferably from 7 to 30. Examples of the monocylic or polycyclic carboxylic acid include aromatic or cycloalkyl carboxylic acids having 0 to 3, preferably 1 or 2 straight-chain or branched alkyl groups having 1 to 30, preferably 1 to 20 carbon atoms. More specific examples include (alkyl)benzene carboxylic acids, (alkyl)naphthalene carboxylic acids, and (alkyl)cycloalkyl carboxylic acids. Preferred examples of the monocylic or polycyclic carboxylic acid include benzoic acid, salicylic acid, alkylbenzoic acid, alkylsalicylic acid, and cyclohexane carboxylic acid.

Examples of the polybasic acid include dibasic acids, tribasic acid, and tetrabasic acids. The polybasic acid may be a chain or cyclic polybasic acid. The chain polybasic acid may be straight-chain or branched and saturated or unsaturated. The chain polybasic acid is preferably a chain polybasic acid having 2 to 16 carbon atoms. Specific examples include ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecandioic acid, straight-chain or branched tridecanedioic acid, straight-chain or branched tetradecanedioic acid, straight-chain or branched heptadecanedioic acid, straight-chain or branched hexadecanedioic acid, straight-chain or branched straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenylsuccinic acids, and mixtures thereof. Examples of the cyclic polybasic acids include alicyclic dicarboxylic acids such as 1,2-cyclohexane dicarboxylic acid and 4-cyclohexene-1,2-dicarboxylic acid, aromatic dicarboxylic acids such as phthalic acid, aromatic tricarboxylic acids such as trimellitic acid, and aromatic tetracarboxylic acids such as pyromellitic acid.

Examples of the molybdenum salts of alcohols include salts of the molybdenum compounds containing no sulfur exemplified with respect to the molybdenum-amine complexes and alcohols. Examples of the alcohols include monohydric alcohols, polyhydric alcohols, partial esters or partial etherified compounds of polyhydric alcohols, and nitrogen compounds having a hydroxyl group (alkanolamines). Molybdic acid is a strong acid and thus forms an ester by reacting with an alcohol. Such an ester is also included within the molybdenum salts of alcohols of the present invention.

The monohydric alcohols may be those having usually 1 to 24 carbon atoms, preferably 1 to 12 carbon atoms, more preferably 1 to 8 carbon atoms. Such alcohols may be straight-chain or branched and saturated or unsaturated. Specific examples of alcohols having 1 to 24 carbon atoms include methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

The polyhydric alcohols may be those of usually dihydric to decahydric, preferably dihydric to hexahydric. Specific examples of the polyhydric alcohols of dihydric to decahydric include dihydric alcohols such as ethylene glycol, diethylene glycol, polyethylene glycol (trimer to pentadecamer of ethylene glycol), propylene glycol, dipropylene glycol, polypropylene glycol (trimer to pentadecamer of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, and neopentyl glycol; polyhydric alcohols such as glycerin, polyglycerin (dimer to octamer thereof, such as diglycerin, triglycerin, and tetraglycerin), trimethylolalkanes (trimethylolethane, trimethylolpropane, trimethylolbutane) and dimers to octamers thereof, pentaerythritol and dimers to tetramers thereof, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, and mannitol; saccharide such as xylose, arabinose, ribose, rhamnose, glucose, fructose, galactose, mannose, sorbose, cellobiose, maltose, isomaltose, trehalose, and sucrose; and mixtures thereof.

Examples of the partial esters of polyhydric alcohols include compounds produced by hydrocarbyl-esterifying a part of the hydroxyl groups of any of the above-exemplified polyhydric alcohols. Among such compounds, preferred examples include glycerin monooleate, glycerin dioleate, sorbitan monooleate, sorbitan dioleate, pentaerythritol monooleate, polyethylene glycol monooleate, and polyglycerin monooleate.

Examples of the partial ethers of polyhydric alcohols include compounds produced by hydrocarbyl-esterifying a part of the hydroxyl groups of any of the above-exemplified polyhydric alcohols and compounds wherein an ether bond is formed by condensation of the polyhydric alcohols with one another (sorbitan condensate or the like). Among these compounds, preferred examples include 3-octadecyloxy-1,2-propanediol, 3-octadecenyloxy-1,2-propanediol, and polyethylene glycol alkylethers.

Examples of the nitrogen compounds having a hydroxyl group include the alkanolamines exemplified with respect to the above-described molybdenum-amine complex and alkanolamides(diethanolamide) wherein the amide group of the alkanolamines is amidized. Among these compounds, preferred examples include stearyl diethanolamine, polyethylene glycol stearylamine, polyethylene glycol dioleylamine, hydroxyethyl laurylamine, and oleic acid diethanolamide.

Preferred examples of the sulfur-containing organic molybdenum compounds in the present invention include sulfurized oxymolybdenum dithiocarbamate and sulfurized oxymolybdenum dithiophosphate because they are particularly excellent in base number retention properties and friction reducing effect as well as the effect of inhibiting the increases of the acid number and viscosity in the presence of NOx. It is also desirable to use the reaction products of the above-described sulfur sources, molybdenum compounds containing no sulfur as a constituent, and sulfur-free basic organic compounds (succinimide) or the above-described molybdenum compounds containing no sulfur as a constituent because they can enhance base number retention properties, oxidation stability and detergency in an diesel engine and in particular the effect of inhibiting wear caused by soot contamination in the composition and further can enhance the effect of inhibiting the increases of the acid number and viscosity in the presence of NOx and are excellent in high-temperature detergency.

When the organic molybdenum compound is used in the present invention, there is no particular restriction on the content thereof. However, the content is preferably from 0.001 percent by mass or more, more preferably 0.005 percent by mass or more, more preferably 0.01 percent by mass or more, and preferably 0.2 percent by mass or less, more preferably 0.1 percent by mass or less, more preferably 0.05 percent by mass or less, particularly preferably 0.03 percent by mass or less, in terms of molybdenum, on the basis of the total mass of the composition. When the organic molybdenum compound is used in an amount of less than 0.001 percent by mass, the resulting composition would be insufficient in thermal/oxidation stability and fail to maintain excellent detergency for a long period of time and further would be poor in the effect of inhibiting the increases of the acid number and viscosity in the presence of NOx. Whereas, when the organic molybdenum compound is used in an amount in excess of 0.2 percent by mass, the resulting composition would fail to exhibit its advantageous effects as balanced with the content and poor in storage stability.

Component (F) of the present invention is a sulfuric extreme pressure additive. When Component (F) is not added, a composition can be obtained which is excellent in base number retention properties. On the other hand, Component (F) is desirously contained because the effect of inhibiting wear caused by soot contamination in the composition can be attained.

Examples of the sulfuric extreme pressure additive include sulfur-containing compounds such as sulfurized fats and oils, sulfurized olefins, dihydrocarbyl(poly)sulfides, dithiocarbamates, zinc dithiocarbamate, thidiazoles, and sulfurized esters. Among these compounds, it is desirable to use those containing sulfur in amount of preferably from 1 to 40 percent by mass, more preferably from 5 to 20 percent by mass, more preferably 5 to 15 percent by mass. A sulfuric extreme pressure additive containing too much sulfur does not necessarily exhibit its advantageous effects such as the effect of inhibiting wear caused by soot contamination in the composition, as balanced with the content and the resulting composition would adversely be poor in base number retention properties and the effect of inhibiting the increases of the acid number and viscosity, while a sulfuric extreme pressure additive containing too less sulfur would be poor in the effect of inhibiting wear caused by soot contamination in the composition and less in the effect of inhibiting the increases of the acid number and viscosity.

Examples of the sulfurized fats and oils include oils such as sulfurized lard, sulfurized rapeseed oil, sulfurized ricinus oil, sulfurized soybean oil, and sulfurized rice bran oil; disulfurized fatty acids such as sulfurized oleic acid; and sulfurized esters such as sulfurized oleic methyl oleate.

Examples of the sulfurized olefins include compounds represented by formula (13) below:

$$R^{11}\text{-}Sx\text{-}R^{12} \quad (13)$$

In formula (13), $R^{11}$ is an alkenyl group having 2 to 15 carbon atoms, $R^{12}$ is an alkyl or alkenyl group having 2 to 15 carbon atoms, and x is an integer of 1 to 8.

The compounds represented by formula (13) can be produced by reacting an olefin having 2 to 15 carbon atoms or a dimer to tetramer thereof with sulfur or a sulphidizing agent such as sulfur chloride. Such an olefin is preferably propylene, isobutene, or diisobutene.

The dihydrocarbyl polysulfide is a compound represented by formula (14) below:

$$R^{13}\text{-}Sy\text{-}R^{14} \quad (14).$$

In formula (14), $R^{13}$ and $R^{14}$ are each independently an alkyl(including cycloalkyl) group having 1 to 20 carbon atoms, an aryl group having 6 to 20 carbon atoms, or an arylalkyl group having 7 to 20 carbon atoms and may be the same or different from one another, and y is an integer of 2 to 8.

Specific examples of $R^{13}$ and $R^{14}$ include methyl, ethyl, n-propyl, isopropyl, n-butyl, isobutyl, sec-butyl, tert-butyl, various pentyl, various hexyl, various heptyl, various octyl, various nonyl, various decyl, various dodecyl, cyclohexyl, phenyl, naphthyl, tolyl, xylyl, benzyl, and phenetyl groups.

Preferred examples of the dihydrocarbyl polysulfide include dibenzyl polysulfides, di-tert-nonylpolysulfides, didodecylpolysulfides, di-tert-butylpolysulfides, dioctylpolysulfides, diphenylpolysulfides, and dicyclohexylpolysulfides.

Examples of the dithiocarbamates include compounds represented by formulas (15) and (16) below:

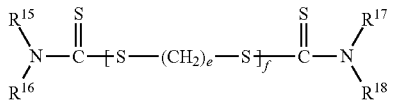

(15)

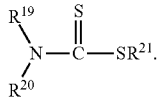

(16)

In formulas (15) and (16), $R^{15}$, $R^{16}$, $R^{17}$, $R^{18}$, $R^{19}$ and $R^{20}$ are each independently a hydrocarbon group having 1 to 30, preferably 1 to 20 carbon atoms, $R^{21}$ is hydrogen or a hydrocarbon group having 1 to 30 carbon atoms, preferably hydrogen or a hydrocarbon group having 1 to 20 carbon atoms, e is an integer of 0 to 4, and f is an integer of 0 to 6.

Examples of the hydrocarbon group having 1 to 30 carbon atoms include alkyl, cycloalkyl, alkylcycloalkyl, alkenyl, aryl, alkylaryl and arylalkyl groups.

Examples of the thiadiazoles include 1,3,4-thidiazole compounds represented by formula (17), 1,2,4-thidiazole compounds represented by formula (18) and 1,4,5-thidiazole compounds represented by formula (19):

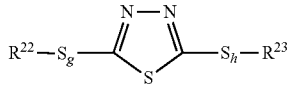

(17)

-continued

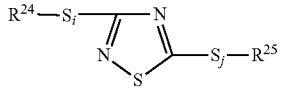

(18)

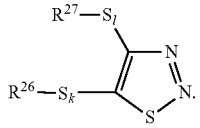

(19)

In formulas (17) to (19), $R^{22}$, $R^{23}$, $R^{24}$, $R^{25}$, $R^{26}$, and $R^{27}$ may be the same or different from each other and are each independently hydrogen or a hydrocarbon group having 1 to 30 carbon atoms, and g, h, i, j, k and l are each independently an integer of 0 to 8.

Examples of the hydrocarbon group having 1 to 30 carbon atoms include alkyl, cycloalkyl, alkylcycloalkyl, alkenyl, aryl, alkylaryl, and arylalkyl groups.

Among the above sulfuric extreme pressure additives, preferred examples include dihydrocarbylpolysulfides, dithiocarbamates and thidiazoles because they render it possible to produce a lubricating oil composition which can inhibit the increases of the acid number and viscosity in the presence of NOx.

When Component (F) is used, there is no particular restriction on the content thereof. However, Component (F) is preferably contained in such a range that the sulfur content of the composition does not exceed 0.3 percent by mass, and preferably from 0.005 to 0.2 percent by mass, more preferably from 0.01 to 0.03 percent by mass, particularly preferably from 0.01 to 0.03 percent by mass. If the content of Component (F) is less than the above range, the resulting composition can not achieve the effect of inhibiting wear caused by soot contamination therein and tends to be poor in the effect of inhibiting the increases of the acid number and viscosity in the presence of NOx. If the content exceeds the above range, the resulting composition would fail to exhibit the advantageous effects as balanced with the content, with poor base number retention properties and also would adversely affect an exhaust gas purifying device due to the large amount of sulfur.

When the lubricating oil composition of the present invention contains Component (F), there is no particular restriction on the mass ratio (S/Mo) of the sulfur content deriving from Component (F) to the molybdenum content deriving from Component (E). However, the mass ratio is preferably from 0.1 to 2, more preferably from 0.2 to 1.5, particularly preferably from 0.5 to 1.2. When (S/Mo) ratio is too high, the resulting composition tends to be poor in base number retention properties. When (S/Mo) ratio is too low, the resulting composition would be less effective in inhibiting wear caused by soot contamination therein.

Due to the above-described component structure, the lubricating oil composition of the present invention is excellent in high-temperature detergency and base number retention properties and can still achieve both these properties and the effect of inhibiting wear caused by soot contamination in the composition, occurring significantly when the content of a phosphorus compound such as ZnDTP is decreased, at a higher level. Furthermore, the lubricating oil composition is also excellent in the effect of inhibiting the increases of the acid number and viscosity in the presence of NOx. However, in order to further enhance these properties or advantageous effects or achieve other objects, the lubricating oil composition of the present invention may further contain additives that have been usually used in a lubricating oil. Examples of such additives include ashless dispersants, anti-oxidants other than Component (D), friction modifiers, anti-wear agents other than Component (B), metallic detergents other than Component (C), corrosion inhibitors, rust inhibitors, demulsifiers, metal deactivators, anti-foaming agents, and dyes.

The ashless dispersant may be any of those usually used in a lubricating oil. Examples of such ashless dispersant include nitrogen-containing compounds having at least one straight-chain or branched alkyl or alkenyl group having 40 to 400 carbon atoms per molecule and derivatives thereof. Examples of such nitrogen-containing compounds include succinimide, benzylamine, polyamines, and Mannich bases. Examples of derivatives of these nitrogen-containing compounds include those produced by allowing a boric compound such as boric acid or borate, a phosphorus compound such as (thio) phosphoric acid or (thio)phosphate, an organic acid, or a hydroxy (poly)oxyalkylene carbonate with these nitrogen-containing compounds. Any one or more of these ashless dispersants may be blended with the lubricating oil composition.

The carbon number of the alkyl or alkenyl group is from 40 to 400, preferably from 60 to 350. The alkyl or alkenyl group of fewer than 40 carbon atoms would cause the poor dissolubility of the compound in the lubricating base oil while the alkyl or alkenyl group of more than 40 carbon atoms would degrade the low-temperature fluidity of the resulting lubricating oil composition. The alkyl or alkenyl group may be straight-chain or branched. Preferred examples include branched alkyl or alkenyl groups derived from an oligomer of an olefin such as propylene, 1-butene, and isobutylene or from a cooligomer of ethylene and propylene.

The ashless dispersant is preferably of a mono and/or bis type, particularly preferably bis type succinimide ashless dispersant, which may or may not contain boron in view of high-temperature detergency.

There is no particular restriction on the content of the ashless dispersant if added. However, the content is usually from 0.01 to 0.4 percent by mass, preferably from 0.05 to 0.2 percent by mass in terms of nitrogen on the basis of the total mass of the lubricating oil composition. In order to further enhance anti-wear properties and high-temperature detergency of the lubricating oil composition, it preferably contains Component (G), i.e., a boron-containing ashless dispersant in a small amount.

The mass ratio (B/N ratio) of the boron content to the nitrogen content in Component (G), preferably boron-containing succinimide ashless dispersant is usually from 0.1 to 5, preferably from 0.1 to 1, more preferably from 0.2 to 0.5. The content of Component (G) is preferably from 0.001 to 0.1 percent by mass, more preferably from 0.005 to 0.05 percent by mass, more preferably from 0.01 to 0.04 percent by mass, particularly preferably from 0.01 to 0.03 percent by mass in terms of boron and preferably from 0.001 to 0.2 percent by mass, more preferably from 0.01 to 0.1 percent by mass, particularly preferably from 0.02 to 0.06 percent by mass in terms of nitrogen.

When Components (G) and (E) are contained in combination, there is no particular restriction on the content ratio (B/Mo) of the boron content (B, mass %) deriving from Component (G) to the molybdenum content (Mo, mass %) deriving from Component (E), which content ratio is preferably 0.01 or greater and preferably 20 or less. However, the content ratio is preferably from 0.1 to 5, more preferably from 0.5 to 2, particularly preferably from 0.8 to 1.5 because the resulting composition is more excellent in the effect of inhibiting the increases of the acid number and viscosity in the presence of NOx and high-temperature detergency. In this case, it is desirable to use a reaction product of the above-described sulfur source, molybdenum compound containing no sulfur as a constituent and sulfur-free basic organic compound (succinimide) or the above-described organic molybdenum compounds containing no sulfur as a constituent. The content ratio (B/Mo) is preferably from 0.01 to 2, more preferably from 0.05 to 1, more preferably from 0.1 to 0.5 because the resulting composition is excellent in the effects of inhibiting the increases of the acid number and viscosity in the presence of NOx and reducing wear. In this case, it is desirable to use sulfurized oxymolybdenum dithiocarbamante, sulfurized oxymolybdenum dithiophosphate, in particular sulfurized oxymolybdenum dithiocarbamate.

When Components (G) and (F) are used in combination, there is no particular restriction on the ratio (S/B) of the content of Component (F) in terms of sulfur (S: mass %) and the content of Component (G) in terms of boron (B: mass %). However, the ratio is preferably from 0.1 to 5, more preferably from 0.2 to 1.5, particularly preferably from 0.5 to 1.2. When the (S/B) ratio is too high, the resulting composition would be poor in base number retention properties. When the (S/B) ratio is too low, the resulting composition would be poor in the effect of inhibiting wear caused by soot contamination therein.

The anti-oxidant other than Component (D) may be any of those generally used in a lubricating oil, such as organic metallic acid anti-oxidants.

The anti-oxidant may be contained in combination with Component (D).

When the lubricating oil composition contains the organic metallic acid anti-oxidant, the content thereof is usually from 0.01 to 20 percent by mass, preferably from 0.1 to 10 percent by mass, more preferably from 0.5 to 5 percent by mass on the basis of the total mass of the composition. When the content is in excess of 20 percent by mass, sufficient properties as balanced with the content is not attained. When the content is less than 10 percent by mass, the resulting composition would be less effective in enhancing the base number retention properties.

Examples of the friction modifier include ashless friction modifiers such as amine compounds, fatty acid esters, fatty acid amides, fatty acids, aliphatic alcohols, aliphatic ethers and hydrazides (oleyl hydrazides), having at least one alkyl or alkenyl group having 6 to 30 carbon atoms, in particular straight-chain alkyl or alkenyl group having 6 to 30 carbon atoms per molecule, semicarbazide, urea (oley urea), ureide, and biuret, and metallic friction modifiers such as molybdenum dithiocarbamates and molybdenum dithiophosphates. The friction modifier may be contained in an amount of usually 0.1 to 5 percent by mass.

The anti-wear agent, other than Component (B) may be any of known anti-wear agents such as boric acid esters, ashless anti-wear agents, metallic anti-wear agents.

The metallic detergent, other than Component (C) may be any of known detergents such as naphthenate and phosphonate metallic detergents. The content of the metallic detergent is from 0.005 to 0.5 percent by mass in terms of metal, on the basis of the total mass of the composition.

Examples of corrosion inhibitors include benzotriazole-, tolyltriazole-, thiadiazole-, and imidazole-type compounds. Among these, benzotriazole type compounds are preferably used because they can enhance the effect of inhibiting the increases of the acid number and viscosity in the presence of NOx, even if added in a small amount.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil, alkenylsuccinic acid derivatives, esters of polyhydroxy aliphatic alcohols and long-chain fatty acids, aromatic amine salts of methylsalicylate and o-hydroxybenzyl alcohol, aluminum stearate, potassium oleate, N-dialkyl-allylamine nitroaminoalkanol, and isoamyloctylphosphate, alkylalkylenediphosphates, metal derivatives of thioethers, metal derivatives of disulfides, fluorine compounds of aliphatic hydrocarbons, triethylsilane, dichlorosilane, alkylphenyl polyethylene glycol ether sulfide, and fluoroalkyl ethers.

When the lubricating oil composition of the present invention contains the above-described additives, the content of each of the corrosion inhibitor, rust inhibitor, and demulsifier is generally from 0.005 to 5 percent by mass, the content of the metal activator is generally from 0.005 to 1 percent by mass, and the content of the anti-foaming agent is generally from 0.0005 to 1 percent by mass, all on the basis of the total mass of the composition.

The sulfur content of the lubricating oil composition of the present invention is preferably 0.3 percent by mass or less, more preferably from 0.26 percent by mass or less, particularly preferably 0.2 percent by mass or less. When the sulfur content is more than 0.3 percent by mass, the service life of the oxidation catalyst, NOx adsorber and DPF in an exhaust-gas after-treatment device would be shortened.

The kinematic viscosity at 100° C. of the lubricating oil composition is usually from 5 to 30 $mm^2/s$ with the objective of maintaining the lubricity of an engine properly. However, it is preferably from 8 to 25 $mm^2/s$, more preferably from 9.3 to 16.3 $mm^2/s$, particularly preferably from 10.5 to 12.5 $mm^2/s$ with the objective of easily maintaining anti-wear properties against wear caused by soot contamination in the composition and inhibiting friction resistance caused by stirring resistance. It is also preferably 25 $mm^2/s$ or less, more preferably 16.3 $mm^2/s$ or less, more preferably 12.5 $mm^2/s$ or less, more preferably 9.3 $mm^2/s$ or less, particularly preferably 9.0 $mm^2/s$ or less in view of excellent low temperature characteristics and fuel efficiency.

The viscosity index of the lubricating oil composition is usually 140 or greater, preferably 150 or greater, more preferably 160 or greater, more preferably 170 or greater, more preferably 180 or greater with the objective of enhancing viscosity-temperature characteristics and fuel efficiency. It is also preferably 250 or less, more preferably 220 or less, more preferably 200 or less, more preferably 190 or less in view of excellent shear stability, high-temperature detergency, and base number retention properties.

The lubricating oil composition of the present invention is excellent in the effect of inhibiting the increases of the viscosity and acid number in the presence of NOx and thus suitable for an internal combustion engine. The lubricating oil composition is also excellent in high-temperature detergency and base number retention properties and also can both maintain these properties and achieve the effect of inhibiting wear caused by soot contamination in the composition, occurring significantly when the content of a phosphorus-containing compound such as ZnDTP is decreased, at a higher level. Therefore, the lubricating oil composition can inhibit an exhaust-gas after-treatment device from being adversely affected and thus is suitable for a diesel or direct injection engine which equipped with an exhaust-gas after-treatment device such as DPF or various catalysts. Not only for such diesel engines, the lubricating oil composition can be suitably used for gasoline engines, diesel engines and gas engines for two- and four-wheeled vehicles, power generators, and cogenerations. Further, the lubricating oil composition can be used suitably not only in these various engines using a fuel, the sulfur content of which is 50 ppm by mass or less but also in various engines for ships and outboard motors. The lubricating oil composition is also suitable for an internal combustion engine using a low-sulfur fuel, the sulfur content of which is 50 ppm by mass or less, preferably 30 ppm by mass or less, particularly preferably 10 ppm by mass or less (for example, gasoline, gas oil, kerosene, alcohol, dimethylether, LPG, natural gas, hydrogen or the like). Since the lubricating oil composition is also excellent in oxidation stability, it is suitably used as a lubricating oil for driving systems of automatic or manual transmissions, greases, wet brake oils, hydraulic oils, turbine oils, compressor oils, bearing oils, refrigerating oils, or the like.

Hereinafter, the present invention will be described in more details by way of the following examples and comparative examples, which should not be construed as limiting the scope of the invention.

Examples 1 to 10, and Comparative Examples 1 to 3

Lubricating oil compositions of the present invention (Examples 1 to 10) and those for comparison (Comparative Examples 1 to 3) were prepared using base oils set forth in Table 1 as set forth in Tables 2 and 3 so that the base number of each of the composition was to be 7 mgKOH/g and subjected to the following evaluation. The mixed base oils used in Examples 1 to 10 and Comparative Example 1 correspond to a lubricating base oil containing the base oil (X) and having a kinematic viscosity at 100° C. of 4.7 $mm^2/s$ and a viscosity index of 125. The mixed base oils used in Comparative Examples 2 and 3 correspond to a lubricating base oil that deviates from the claimed range because it contains the base oil (X) in an amount of less than 40 percent by mass and had a kinematic viscosity at 100° C. of 4.9 $mm^2/s$ and a viscosity index of 111.

High-Temperature Detergency Evaluated by Hot Tube Test

A hot tube test was carried out in accordance with JPI-5S-55-99. Each of the compositions was rated from 10 to 0. A rating of 10 indicates colorless and transparent (no deposit) and a rating of 0 point indicates black and opaque. Between 10 and 0, evaluation was done using reference tubes which were made per grade beforehand. At 290° C., a rating of 6 or greater indicates that the composition is considered as a lubricating oil with excellent detergency for an ordinary gasoline or diesel engine. However, excellent detergency even at 300° C. or higher is preferably exhibited.

Base Number Retention Properties

Each of the compositions was forced to deteriorate at 165.5° C. by an Indiana Stirring Oxidation test in accordance with JIS K 2514 so as to measure the remaining base number (mgKOH/g) after 96 hours. The results are set forth in Tables 2 and 3.

Evaluation of anti-wear properties when carbon black is mixed in

Carbon black was dispersed in an amount of 1.5 percent by mass in each of the compositions. A high-speed four-ball test was conducted for each lubricating oil composition under the following conditions in accordance with JPI-5S-32-90 so as to measure the wear scar diameter after the test. A smaller scar diameter indicates that the composition is more excellent in anti-wear properties.

Rotating speed: 1500 rpm

Load: 294 N

Test oil temperature: 110° C.

Test time: one hour

As apparent from the results set forth in Tables 2 and 3, the composition of Example 1 containing the specific base oil and component (a) according to the present invention was excellent in high-temperature detergency and base number retention properties. The compositions of Examples 2 to 10 containing components (a) and (b) was rated 5 or greater in the hot tube test at 300° C. and had a remaining base number rate of 1.0 mgKOH/g or greater and thus found to be significantly improved in anti-wear properties against wear caused by soot contamination in the compositions, maintaining high-temperature detergency and base number retention properties. In particular, when component (b1), the PSSI of which corresponds to 1 to 20 was used (Examples 1 to 6), anti-wear properties against wear caused by soot contamination in the compositions was able to be significantly improved. When components (b2) to (b4) were used (Examples 7 to 10), it is apparent that the remaining base number rate was maintained at a high level. Further, when Component (F) was not contained (Example 5), the composition was more excellent in base number retention properties. When Component (F) was contained, the composition was more excellent in anti-wear properties against wear caused by soot contamination in the composition (from comparison between Examples 2 and 5). When ZDTP having a primary alkyl group was contained (Example 4), the composition was not only capable of maintaining the remaining base number at a high level but also further improved in anti-wear properties against wear caused by soot contamination in the composition.

On the other hand, when a dispersant type polymethacrylate viscosity index improver was contained alone in such an amount that the viscosity index of the composition was to be 170 or greater (Comparative Example 1), the composition was not sufficient in high-temperature detergency even though it contained the base oil specified by the present invention. When the base oil specified by the present invention was not used (Comparative Examples 2 and 3) the compositions were found to be small in remaining base number and insufficient in base number retention properties.

Examples 11 to 16, and Comparative Examples 4 and 5

Lubricating oil compositions of the present invention (Examples 11 to 16) and those for comparison (Comparative Examples 4 and 5) were prepared using base oils set forth in Table 4 as set forth in Table 5 so that the kinematic viscosity at 100° C. of each of the composition was to be 8.7 $mm^2/s$ and subjected to the following evaluation.

Increases in Acid Number and Viscosity

A NOx adsorbing test was carried out under conditions where NOx concentration was 1200 ppm, oxygen concentration was 85%, and temperature was 140° C., and the acid number of each composition was measured before the test and 168 hours later thereof so as to evaluate the acid number increase (mgKOH/g). Similarly, the kinematic viscosity at 100° C. was measured before the test and 168 hours later thereof so as to evaluate the viscosity ratio therebetween. A composition with a small acid number increase and small viscosity ratio is regarded as being excellent in oxidation stability in the presence of NOx.

As apparent from the results set forth in Table 5, the lubricating oil compositions of Comparative Examples 4 and 5 did not contain Component (D) or (E) and thus was significantly increased in acid number. Whereas, the lubricating oil compositions of Examples 11 to 16 contain Components (D) and (E) in combination and thus were able to synergistically inhibit the increase of the acid number in the presence of NOx and were significant in the effect of inhibiting the increase of the viscosity. When base oils D and E are compared with base oil F, it was found that slight composition differences such as a difference in the ratio of the tertiary carbon in the base oil are contributive to an enhancement in properties even though the compositions of the base oils were similar. When a base oil the ratio of the tertiary carbon of which was less than 6.3 percent was used, the composition was extremely poor in the effect of inhibiting the increases of the acid number and viscosity even though Components (D) and (E) were used in combination.

TABLE 1

| | | Base Oil A | Base Oil B | Base Oil C |
|---|---|---|---|---|
| Feedstock | | Vacuum-distillate[1)] | Vacuum-distillate[1)] | Vacuum-distillate[2)] |
| Refinining process | | Hydrocracking[3)] | Hydrocracking[3)] | Solvent refining[4)] |
| Dewaxing process | | Solvent dewaxing[5)] | Solvent dewaxing[5)] | Solvent dewaxing[5)] |
| Kinematic viscosity (100° C.) | $mm^2/s$ | 4.1 | 6.6 | 4.4 |
| Viscosity index | | 120 | 129 | 100 |
| Pour point | ° C. | −22.5 | −17.5 | −15.0 |
| Aniline point | ° C. | 112 | 121 | 99 |
| Iodine number | | 0.8 | 5.3 | 3.8 |
| Sulfur content | mass ppm | 2 | 6 | 1300 |
| Nitrogen content | mass ppm | <3 | <3 | 6 |
| NOACK evaporation loss | mass % | 17 | 7 | 21 |
| EI-MS analysis (in accordance with ASTM D 2786-91) Paraffins and naphthenes in the saturates | | | | |
| Paraffins | mass % | 53 | 53 | 34 |
| Naphthenes (1 to 6 rings) | mass % | 47 | 44 | 66 |
| 1 ring naphthenes | mass % | 17 | 17 | 16 |
| 2 to 6 ring naphthenes | mass % | 30 | 27 | 50 |
| Paraffins + 1 ring naphthens | mass % | 70 | 70 | 50 |
| Paraffins/1 ring naphthenes | | 3.1 | 3.1 | 2.1 |
| % $C_P$ | | 78 | 78 | 66 |

TABLE 1-continued

| | Base Oil A | Base Oil B | Base Oil C |
|---|---|---|---|
| % $C_N$ | 21 | 21 | 29 |
| % $C_A$ | 1 | 1 | 5 |
| % $C_P$/% $C_N$ | 3.8 | 3.8 | 2.3 |
| $^{13}$C-NMR analysis | | | |
| Integrated intensity deriving from the whole carbon atoms[6)] | 100 | 100 | 100 |
| Integrated intensity deriving from tertiary carbon atoms[7)] | 6.9 | 7 | 6.1 |
| Average carbon number | 29 | 34 | 27 |

[1)]atmospheric distillation bottom from crude oil was subjected to vacuum-distillation and then desulfurization to be hydrocracking feed stock

[2)]atmospheric distillation bottom from crude oil was subjected to vacuum-distillation and fractional distillation

[3)]process wherein aromatics, nitrogen compounds, sulfur compounds or the like were hydrocracked using a catalyst supporting a metal containing a VIII group transition metal as the main component

[4)]process containing a solvent refining process using a solvent such as furfural and hydrogenation refining process

[5)]solvent dewaxing process with a solvent such as MEK or the like

[6)]total of integrated intensity at a chemical shift of 0-50 ppm

[7)]total of integrated intensity at chemical shifts of 27.9-28.1, 28.4-28.6, 32.6-33.2, 34.4-34.6, 37.4-37.6, 38.8-39.1, 40.4-40.6 ppm

TABLE 2

| | | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|---|
| Lubricating base oil (on the basis of total amount of base oil) | | | | | | | | | | | |
| (X) | Base oil A[1)] | mass % | 70 | 70 | 70 | 70 | 70 | 70 | 70 | — | — |
| (X) | Base oil B[2)] | mass % | 30 | 30 | 30 | 30 | 30 | 30 | 30 | 30 | 30 |
| (X) | Base oil C[3)] | mass % | — | — | — | — | — | — | — | 70 | 70 |
| Additives (on the basis of total amount of composition) | | | | | | | | | | | |
| (a) | Non-dispersant type OCP[4)] | mass % | 6.7 | 5.2 | 5.2 | 5.2 | 5.2 | 5.2 | — | 5.2 | 5.2 |
| (b)1a | Dispersant type PMA[5)] | mass % | — | 1.5 | 4.0 | 1.5 | 1.5 | 1.5 | 6.7 | 1.5 | 1.5 |
| (B1) | Sec-ZDTP (amount of P)[6)] | mass % | 0.05 | 0.05 | 0.05 | 0.03 | 0.05 | 0.05 | 0.05 | 0.05 | 0.10 |
| (B2) | Prim-ZDTP (amount of P)[7)] | mass % | — | — | — | 0.02 | — | — | — | — | — |
| (C)-1 | Ca salicylate (amount of Ca)[8)] | mass % | 0.2 | 0.2 | 0.2 | 0.2 | 0.2 | 0.2 | 0.2 | 0.2 | 0.2 |
| (E)-1 | Sulfur-free organic Mo compound[9)] | mass % | 0.2 | 0.2 | 0.2 | 0.2 | 0.2 | — | 0.2 | 0.2 | 0.2 |
| (E)-2 | Sulfur-containing organic Mo compound[10)] | mass % | — | — | — | — | — | 0.5 | — | — | — |
| (F)-1 | Sulfurized fats and oils[11)] | mass % | 0.2 | 0.2 | 0.2 | 0.2 | — | 0.2 | 0.2 | 0.2 | 0.2 |
| (G)-1 | Boric acid-modified succinimide[12)] | mass % | 2.0 | 2.0 | 2.0 | 2.0 | 2.0 | 2.0 | 2.0 | 2.0 | 2.0 |
| (H) | Package of other additives[13)] | mass % | 7.8 | 7.8 | 7.8 | 7.8 | 7.8 | 7.8 | 7.8 | 7.8 | 7.8 |
| Kinematic viscosity at 100° C. of composition | | $mm^2/s$ | 11.5 | 11.0 | 12.9 | 11.0 | 11.0 | 11.0 | 10.0 | 11.9 | 11.9 |
| Viscosity index of composition | | | 173 | 174 | 182 | 174 | 174 | 174 | 189 | 159 | 159 |
| Sulfur content of composition | | mass % | 0.19 | 0.19 | 0.19 | 0.19 | 0.17 | 0.24 | 0.19 | 0.29 | 0.41 |
| Base number (HCl method) | | mgKOH/g | (7.60) | (7.60) | (7.60) | 7.60 | (7.60) | (7.60) | (7.60) | (7.60) | (7.60) |
| Hot tube test (300° C.) | | | | | | | | | | | |
| Lacquer rating | | rating | 9 | 7 | 5 | 7 | 7 | 6 | 2 | 6 | 3 |
| ISOT 165.5° C. × 96 h | | | | | | | | | | | |
| Remaining base number (HCl method) | | mgKOH/g | 1.07 | 1.04 | 1.07 | 1.65 | 1.20 | 1.25 | 0.99 | 0.34 | <0.1 |
| Four-ball wear test (1.5 mass % of CB was dispersed) | | | | | | | | | | | |
| Wear scar | | mm | 0.75 | 0.53 | 0.55 | 0.52 | 0.62 | 0.57 | 0.49 | 0.57 | 0.55 |

[1)] to [3)]see Table 1

[4)]Non-dispersant type olefin copolymer (ethylene-α-olefin copolymer: PSSI: 30)

[5)]Dispersant type polymethacrylate (PSSI: 5)

[6)]secondary C4/secondary C6-ZnDTP (Zn: 7.2 mass %, P: 6.2 mass %, S: 14.9 mass %)

[7)]primary C8-ZnDTP (Zn: 8.2 mass %, P: 6.3 mass %, S: 14.7 mass %)

[8)]Calcium carbonate overbased salt of alkylsalicylic acid calcium salt having secondary C14-C18 alkyl group (base number: 170 mgKOH/g, Ca: 6 mass %, metal ratio: 2.7) (structure of alkylsalicylic acid: 3-alkyl: 53 mol %, 4-alkyl: 4 mol %, 5-alkyl: 3 mol %, 3,5-dialkyl: 8 mol %)

[9)]Ditridecylamine complex of oxymolybdenum, Mo: 9.7 mass %, S: 0 mass %

[10)]Sulfurized oxymolybdenum dithiocarbamate, Mo: 10.0 mass %, S: 10.0 mass %

[11)]Sulfurized fats and oils (S: 10.3 mass %)

[12)]Boric acid-modified polybutenyl succinimide (N: 1.5 mass %, B: 0.5 mass %)

[13)]Semi-packaged additive containing dispersant, ashless anti-oxidant, anti-foaming agent

TABLE 3

| | | | Example 7 | Example 8 | Example 9 | Example 10 |
|---|---|---|---|---|---|---|
| Lubricating base oil (on the basis of total amount of base oil) | | | | | | |
| (X) | Base oil A[1)] | mass % | 70 | 70 | 70 | 70 |
| (X) | Base oil B[2)] | mass % | 30 | 30 | 30 | 30 |
| Additives (on the basis of total amount of composition) | | | | | | |
| (a) | Non-dispersant type OCP[3)] | mass % | 5.2 | 5.2 | 5.2 | 5.2 |
| (b)1b | Dispersant type PMA[4)] | mass % | 1.5 | — | — | — |
| (b)2 | Dispersant type OCP[5)] | mass % | — | 1.5 | — | — |
| (b)3 | Dispersant type mixed polymer[6)] | mass % | — | — | 1.5 | — |
| (b)4 | Non-dispersant type PMA[7)] | mass % | — | — | — | 1.5 |
| (B1) | sec-ZDTP (amount of P)[8)] | mass % | 0.05 | 0.05 | 0.05 | 0.05 |
| (C)-1 | Salicylate (amount of Ca)[9)] | mass % | 0.2 | 0.2 | 0.2 | 0.2 |
| (E)-1 | Sulfur-free organic Mo compaund[10)] | mass % | 0.2 | 0.2 | 0.2 | 0.2 |
| (F)-1 | Sulfurized fats and oils[11)] | mass % | 0.2 | 0.2 | 0.2 | 0.2 |
| (G)-1 | Boric acid-modified succinimide[12)] | mass % | 2.0 | 2.0 | 2.0 | 2.0 |
| (H) | Package of other additives[13)] | mass % | 7.8 | 7.8 | 7.8 | 7.8 |
| Kinematic viscosity at 100° C. of composition | | $mm^2/s$ | 11.3 | 11.4 | 11.3 | 11.4 |
| Viscosity index of composition | | | 177 | 172 | 173 | 179 |
| Sulfur content of composition | | mass % | 0.19 | 0.19 | 0.19 | 0.19 |
| Hot tube test (300° C.) | | | | | | |
| Lacquer rating | | rating | 7 | 8 | 8 | 7 |
| ISOT 165.5° C. × 96 h | | | | | | |
| remaining base number (HCl method) | | mgKOH/g | 1.03 | 1.11 | 1.13 | 1.15 |
| Four-ball wear test (1.5 mass % of CB was dispersed) | | | | | | |
| Wear scar | | mm | 0.56 | 0.64 | 0.63 | 0.67 |

[1)] and [2)]see Table 1
[3)]same as component a in Table 2
[4)]Dispersant type polymethacrylate (PSSI: 30)
[5)]Dispersant type ethylene-α-olefin copolymer (PSSI: 30)
[6)]Dispersant (graft polymer of polymethacrylate-olefin copolymer) (PSSI: 30)
[7)]Non-dispersant type polymethacrylate (PSSI: 30)
[8)]same as component B-1 in Table 2
[9)]same as component C-1 in Table 2
[10)]same as component E-1 in Table 2
[11)]same as component F-1 in Table 2
[12)]same as component G-1 in Table 2
[13)]same as component H in Table 2

TABLE 4

| | | Base Oil D | Base Oil E | Base Oil F |
|---|---|---|---|---|
| Feedstock | | Vacuum-distillate[1)] | Vacuum-distillate[1)] | Vacuum-distillate[1)] |
| Refinining process | | Hydrocracking[2)] | Hydrocracking[2)] | Hydrocracking[2)] |
| Dewaxing process | | hydro-isomerization[3)] | hydro-isomerization[3)] | Solvent dewaxing[4)] |
| Kinematic viscosity (40° C.) | $mm^2/s$ | 20.0 | 20.8 | 18.7 |
| Kinematic viscosity (100° C.) | $mm^2/s$ | 4.3 | 4.45 | 4.1 |
| Viscosity index | | 123 | 128 | 120 |
| Pour point | ° C. | −17.5 | −22.5 | −22.5 |
| CCS viscosity (−30° C.) | mPa · s | 1700 | 1610 | 1750 |
| Aniline point | ° C. | 116 | 119 | 112 |
| Iodine number | | 0.05 | 0.03 | 0.8 |
| NOACK evaporation loss mass % | mass % | 14 | 10.6 | 17 |
| % $C_P$ | | 78.9 | 87.2 | 78 |
| % $C_N$ | | 21.1 | 12.8 | 20.7 |
| % $C_A$ | | 0 | 0 | 1.3 |
| Paraffins | | 54 | 76.7 | 53.2 |
| 1 ring naphthenes | | 20.1 | 10.7 | 16.9 |
| 2 to 6 ring naphthenes | | 25.9 | 12.6 | 29.9 |
| ½ ring + naphthenes | | 0.78 | 0.85 | 0.57 |

TABLE 4-continued

| | Base Oil D | Base Oil E | Base Oil F |
|---|---|---|---|
| $^{13}$C-NMR analysis | | | |
| Integrated intensity deriving from the whole carbon atoms[5)] | 100 | 100 | 100 |
| Integrated intensity deriving from tertiary carbon atoms[6)] | 8 | 8.5 | 6.9 |
| Average carbon number | 29 | 29 | 29 |

[1)]atmospheric distillation bottom from crude oil was subjected to vacuum-distillation and then desulfurization to be hydrocracking feed stock
[2)]process wherein aromatics, nitrogen compounds, sulfur compounds or the like were hydrocracked using a catalyst supporting a metal containing a VIII group transition metal as the main component
[3)]dewaxing process wherein a part of wax components is cracked and hydroisomerized
[4)]solvent dewaxing process with a solvent such as MEK or the like
[5)]total of integrated intensity at a chemical shift of 10-50 ppm
[6)]total of integrated intensity at chemical shifts of 27.9-28.1, 28.4-28.6, 32.6-33.2, 34.4-34.6, 37.4-37.6, 38.8-39.1, 40.4-40.6 ppm

TABLE 5

| | | Example11 | Example 12 | Example 13 | Example 14 | Example 15 | Example 16 | Comparative Example 4 | Comparative Example 5 |
|---|---|---|---|---|---|---|---|---|---|
| Lubricating base oil (on the basis of total amount of base oil) | | | | | | | | | |
| (X) Base oil D[1)] | mass % | 100 | 100 | 100 | | | | | |
| (X) Base oil E[2)] | mass % | | | | 100 | | | | |
| (X) Base oil F[3)] | mass % | | | | | 100 | 100 | 100 | 100 |
| Additives (on the basis of total amount of composition) | | | | | | | | | |
| (D) Phenolic ashless anti-oxidant[4)] | mass % | 1 | — | 1 | 1 | 1 | — | — | — |
| (D) Aminic ashless anti-oxidant[5)] | mass % | — | 1.5 | — | — | — | 1.5 | 1.5 | — |
| (E) Sulfer-containing Mo complex (in terms of Mo)[6)] | mass % | 0.07 | 0.07 | — | 0.07 | 0.07 | 0.07 | — | 0.07 |
| (E) Mo amine complex (amount of Mo)[7)] | mass % | — | — | 0.02 | — | — | — | — | — |
| Other additives | | | | | | | | | |
| (B1) ZDTP (amount of P)[8)] | mass % | 0.1 | 0.1 | — | 0.1 | 0.1 | 0.1 | 0.1 | 0.1 |
| (B3) ZP (amount of P)[9)] | mass % | — | — | 0.1 | — | — | — | — | — |
| (C) Metallic detergent (amount of metal)[10)] | mass % | 0.2 | 0.2 | 0.2 | 0.2 | 0.2 | 0.2 | 0.2 | 0.2 |
| (G) Boric acid-modified succinimide[11)] | mass % | 2 | 2 | 2 | 2 | 2 | 2 | 2 | 2 |
| Succinimide[12)] | mass % | 3 | 3 | 3 | 3 | 3 | 3 | 3 | 3 |
| Benzotriazole | | 0.01 | — | — | 0.01 | 0.01 | — | — | — |
| (A) Viscosity index improver and the like | | 5.6 | 5.6 | 5.6 | 5.4 | 6.0 | 6.0 | 6.0 | 6.0 |
| Kinematic viscosity 100° C. | $mm^2/s$ | 8.7 | 8.7 | 8.8 | 8.7 | 8.7 | 8.7 | 8.7 | 8.6 |
| Viscosity index | | 201 | 201 | 202 | 198 | 211 | 211 | 211 | 211 |
| Increase in acid number after NOx adsorbing test[13)] | mgKOH/g | 10.9 | 11.7 | 8.3 | 10.7 | 14.2 | 15.8 | >30 | >30 |
| Viscosity ratio after NO*x* adsorbing test (100° C.)[13)] | | 1.7 | 1.9 | 1.4 | 1.7 | 2.7 | 3.0 | — | — |

[1)] to [3)]see Table 4
[4)]4,4'-methylene bis (2.6-di-tert-butylphenol)
[5)]dialkyldiphenylamine (alkyl group: C4 or C8)
[6)]sulfurized oxymolybdenum dialkyldithiocarbamate (alkyl group: C8 or C13)
[7)]ditridecyl amine complex of oxymolybdenum
[8)]zinc dialkyldithiophosphate (alkyl group: secondary C8)
[9)]zinc dialkylphosphate (alkyl group: C8)
[10)]Ca salicylate: Calcium carbonate overbased salt of alkylsalicylic acid calcium salt having secondary C14-C18 alkyl group (base number 170 mgKOH/g, Ca: 6 mass %) (structure of Ca salt of alkylsalicylate: 3-alkyl: 53 mol %, 4-alkyl: 4 mol %, 5-alkyl: 35 mol %, 3,5-dialkyl: 8 mol %)
[11)]boric acid-modified polybutenyl succinimide (Mn of polybutenyl group: 1300, nitrogen content: 1.8 mass %, boron content: 0.77 mass %)
[12)]polybutenylsuccinimide (Mn of polybutenyl group: 1300, nitrogen content: 1.8 mass %)
[13)]140° C. × 168 hours later

We claim:

1. A lubricating oil composition comprising:

a lubricating base oil containing, on the basis of the total mass thereof, 40 percent by mass or more of base oil (X) with a kinematic viscosity at 100° C. of 1 to 8 $mm^2/s$, a pour point of −15° C. or lower, an aniline point of 100° C. or higher, and a viscosity index of 100 to 135, the saturates of the base oil containing 40 to 57 percent by mass of paraffins and 43 to 60 percent by mass of naphthenes, wherein a mass ratio of one ring naphthenes to two to six ring naphthenes is 0.78 or less, the ratio of the tertiary carbon in the whole carbon constituting the base oil being 6.3 percent or greater;

(A) (a) a non-dispersant type olefin (co)polymer viscosity index improver in such an amount that the viscosity index of the composition is 150 or greater, and at least one type of additive selected from the group consisting of:

(B) a phosphorus-containing anti-wear agent;

(C) a metallic detergent:

(D) an ashless anti-oxidant; and (E) an organic molybdenum compound.

2. The lubricating oil composition according to claim 1, wherein the at least one type of additive comprises (B) a phosphorus-containing anti-wear agent in an amount of 0.01 to 0.2 percent by mass in terms of phosphorus and (C) a metallic detergent in an amount of 0.01 to 1 percent by mass in terms of metal, all on the basis of the total mass of the composition.

3. The lubricating oil composition according to claim 1, wherein the at least one type of additive comprises (D) an ashless anti-oxidant and (E) an organic molybdenum compound.

4. The lubricating oil composition according to claim 1, wherein the iodine number of said base oil (X) is 2 or less.

5. The lubricating oil composition according to claim 1, wherein said base oil (X) is a base oil produced through a process including a catalytic dewaxing process.

6. The lubricating oil composition according to claim 1, further comprising (b) a viscosity index improver other than component (a), as Component (A) to be such that the content ratio (mass ratio) of component (b) to the total amount of components (a) and (b) is to be 0.5 or less.

7. The lubricating oil composition according to claim 2, further comprising one or more type of additive selected from the group consisting of (E) an organic molybdenum compound, (F) a sulfuric extreme pressure additive and (G) a boron-containing ashless dispersant.

8. The lubricating oil composition according to claim 1, wherein it is an engine oil composition suitable for diesel or direct injection gasoline engines.

9. The lubricating oil composition according to claim 2, further comprising (b) a viscosity index improver other than component (a), as Component (A) to be such that the content ratio (mass ratio) of component (b) to the total amount of components (a) and (b) is to be 0.5 or less.

10. The lubricating oil composition according to claim 6, further comprising one or more type of additive selected from the group consisting of (E) an organic molybdenum compound, (F) a sulfuric extreme pressure additive and (G) a boron-containing ashless dispersant.

11. The lubricating oil composition according to claim 2, wherein it is an engine oil composition suitable for diesel or direct injection gasoline engines.

12. The lubricating oil composition according to claim 6, wherein it is an engine oil composition suitable for diesel or direct injection gasoline engines.

13. The lubricating oil composition according to claim 7, wherein it is an engine oil composition suitable for diesel or direct injection gasoline engines.

14. The lubricating oil composition according to claim 1, wherein a content of two to six ring naphthenes in the saturates of the lubricating base oil is 10 percent by mass or more.

* * * * *